US010632736B2

(12) United States Patent
Aviles et al.

(10) Patent No.: US 10,632,736 B2
(45) Date of Patent: Apr. 28, 2020

(54) SYSTEMS AND METHODS OF APPLYING COMPOSITIONS TO WEBS

(71) Applicant: The Procter & Gamble Company, Cincinnati, OH (US)

(72) Inventors: Misael Omar Aviles, Hamilton, OH (US); Martin James, Hamilton, OH (US); Stephen Michael Varga, Loveland, OH (US); Hui Yang, Cincinnati, OH (US); Arman Ashraf, Mason, OH (US); Eric Daniel Ricciardi, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/423,624

(22) Filed: Feb. 3, 2017

(65) Prior Publication Data

US 2017/0225449 A1 Aug. 10, 2017

Related U.S. Application Data

(60) Provisional application No. 62/291,709, filed on Feb. 5, 2016.

(51) Int. Cl.

| | |
|---|---|
| ***B41F 21/00*** | (2006.01) |
| ***B41M 5/00*** | (2006.01) |
| ***D06P 5/30*** | (2006.01) |

(52) U.S. Cl.

CPC ..... *B41F 21/00* (2013.01); *B41M 5/0047* (2013.01); *B41M 5/0064* (2013.01); *D06P 5/30* (2013.01); *B41M 5/0088* (2013.01)

(58) Field of Classification Search

CPC . B41F 21/00; B05D 3/00; D04H 1/42; B41M 5/0047; B41M 5/0064; B41M 5/0088; D06P 5/30

See application file for complete search history.

(56) References Cited

U.S. PATENT DOCUMENTS

| | | | |
|---|---|---|---|
| 3,265,500 | A | 8/1966 | Lewis |
| 3,759,261 | A | 9/1973 | Wang |
| 4,098,630 | A | 7/1978 | Morse |
| 4,231,370 | A | 11/1980 | Mroz et al. |
| 4,243,446 | A | 1/1981 | Mathey |
| 4,275,105 | A | 6/1981 | Boyd et al. |
| 4,355,066 | A | 10/1982 | Newman |

(Continued)

FOREIGN PATENT DOCUMENTS

| | | | |
|---|---|---|---|
| EP | 0951889 | A1 | 10/1999 |
| EP | 1527898 | A1 | 5/2005 |

(Continued)

OTHER PUBLICATIONS

U.S. Appl. No. 15/698,709, filed Sep. 8, 2017, Aviles et al.

(Continued)

*Primary Examiner* — David H Banh
(74) *Attorney, Agent, or Firm* — George H. Leal

(57) ABSTRACT

A method of printing composition(s) on a web is disclosed. The method includes the steps of advancing the web and printing a plurality of composition sites on the web. The method further includes the step of forming one or more discontinuities in the web. The discontinuities correspond to the printed composition sites.

12 Claims, 18 Drawing Sheets

(56) References Cited

U.S. PATENT DOCUMENTS

| | | | | |
|---|---|---|---|---|
| 4,738,674 | A | 4/1988 | Todd et al. | |
| 4,909,879 | A | 3/1990 | Ball | |
| 5,161,829 | A | 11/1992 | Detrick et al. | |
| 5,288,348 | A | 2/1994 | Modrak | |
| 5,332,613 | A | 7/1994 | Taylor et al. | |
| 5,354,289 | A | 10/1994 | Mitchell et al. | |
| 5,417,789 | A | 5/1995 | Lauritzen | |
| 5,458,590 | A | 10/1995 | Schleinz et al. | |
| 5,470,640 | A | 11/1995 | Modrak | |
| 5,503,076 | A | 4/1996 | Yeo | |
| 5,705,011 | A | 1/1998 | Bodford et al. | |
| 5,766,389 | A | 6/1998 | Brandon et al. | |
| 5,785,697 | A | 7/1998 | Trombetta et al. | |
| 5,900,109 | A | 5/1999 | Sanders et al. | |
| 6,096,412 | A | 8/2000 | McFarland et al. | |
| 6,127,595 | A | 10/2000 | Makoui et al. | |
| 6,284,942 | B1 | 9/2001 | Rabin | |
| 6,307,119 | B1 | 10/2001 | Cammarota et al. | |
| 6,322,665 | B1 | 11/2001 | Sun et al. | |
| 6,403,857 | B1 | 6/2002 | Gross et al. | |
| 6,531,027 | B1 | 3/2003 | Lender et al. | |
| 6,572,575 | B1 | 6/2003 | Shimada et al. | |
| 6,586,653 | B2 | 7/2003 | Graeme, III et al. | |
| 6,624,100 | B1 | 9/2003 | Pike | |
| 6,627,022 | B2 | 9/2003 | Fusco | |
| 7,306,699 | B2 | 12/2007 | Urlaub et al. | |
| 7,736,688 | B2 * | 6/2010 | Oetjen | D04H 3/00 427/2.1 |
| 7,816,285 | B2 | 10/2010 | MacDonald et al. | |
| 8,012,297 | B2 | 9/2011 | Baldauf | |
| 8,153,226 | B2 | 4/2012 | Curro et al. | |
| 8,158,253 | B2 | 4/2012 | Spinks | |
| 8,575,417 | B2 * | 11/2013 | Oetjen | A61F 13/512 604/367 |
| 8,613,995 | B2 * | 12/2013 | Stone | B26F 1/26 428/156 |
| 8,691,041 | B2 | 4/2014 | Oetjen | |
| 8,940,384 | B2 * | 1/2015 | Stone | B26F 1/26 428/156 |
| 8,945,334 | B2 | 2/2015 | Oetjen | |
| 9,012,014 | B2 * | 4/2015 | Stone | B26F 1/26 428/172 |
| 9,050,220 | B2 | 6/2015 | Digiacomantonio et al. | |
| 9,237,973 | B2 | 1/2016 | Abuto et al. | |
| 9,330,067 | B2 * | 5/2016 | Ueminami | A61F 13/512 |
| 9,414,971 | B2 | 8/2016 | Oetjen | |
| 9,610,200 | B2 | 4/2017 | Oetjen | |
| 9,642,752 | B2 | 5/2017 | Oetjen | |
| 9,707,133 | B2 | 7/2017 | Digiacomantonio et al. | |
| 2001/0044611 | A1 | 11/2001 | Noda et al. | |
| 2002/0002358 | A1 | 1/2002 | Durrance et al. | |
| 2002/0112832 | A1 | 8/2002 | Burazin et al. | |
| 2003/0021951 | A1 * | 1/2003 | Desai | A61F 13/512 428/131 |
| 2003/0065299 | A1 | 4/2003 | Carlucci et al. | |
| 2003/0114818 | A1 | 6/2003 | Benecke et al. | |
| 2004/0122386 | A1 | 6/2004 | Mocadlo | |
| 2004/0158212 | A1 * | 8/2004 | Ponomarenko | A61F 13/15203 604/367 |
| 2004/0170813 | A1 | 9/2004 | Digiacomantonio et al. | |
| 2004/0176736 | A1 | 9/2004 | Christon et al. | |
| 2005/0279470 | A1 * | 12/2005 | Redd | B31F 1/07 162/109 |
| 2006/0286343 | A1 * | 12/2006 | Curro | A61F 13/00 428/131 |
| 2007/0026209 | A1 | 2/2007 | MacDonald et al. | |
| 2008/0036196 | A1 | 2/2008 | Steenblik et al. | |
| 2008/0132872 | A1 | 6/2008 | Trennepohl et al. | |
| 2008/0154226 | A9 * | 6/2008 | Hammons | A44B 18/0011 604/384 |
| 2008/0208154 | A1 * | 8/2008 | Oetjen | D04H 3/00 604/367 |
| 2010/0036352 | A1 | 2/2010 | Hood et al. | |
| 2011/0106035 | A1 | 5/2011 | Arora et al. | |
| 2011/0112499 | A1 | 5/2011 | Trennepohl et al. | |
| 2014/0296814 | A1 | 10/2014 | Gray et al. | |
| 2015/0173964 | A1 | 6/2015 | Coe et al. | |
| 2016/0076184 | A1 * | 3/2016 | Orr | D04H 1/492 428/178 |
| 2016/0129626 | A1 * | 5/2016 | Arora | B32B 5/022 264/40.1 |
| 2016/0331596 | A1 | 11/2016 | Oetjen | |
| 2017/0120260 | A1 | 5/2017 | Oetjen | |
| 2017/0210110 | A1 | 7/2017 | Oetjen | |
| 2017/0258650 | A1 * | 9/2017 | Rosati | A61F 13/51104 |

FOREIGN PATENT DOCUMENTS

| | | | |
|---|---|---|---|
| WO | WO03020835 | A1 | 3/2003 |
| WO | WO2007070132 | A1 | 6/2007 |
| WO | WO2008103650 | A2 | 8/2008 |
| WO | WO2010071543 | A1 | 6/2010 |

OTHER PUBLICATIONS

U.S. Appl. No. 15/626,386, filed Jun. 19, 2017, Digiacomantonio, et al.

Search Report and Written Opinion for PCT/US2017/018324 dated May 30, 2017.

Hatch, Kathryn, "Nonwoven Fabrics Structures", Textile Science, 1993, p. 363.

* cited by examiner

SYSTEMS AND METHODS OF APPLYING COMPOSITIONS TO WEBS

FIELD OF THE INVENTION

The present invention pertains to the application of compositions to webs.

BACKGROUND OF THE INVENTION

Nonwovens, films, and laminates thereof are widely used in disposable absorbent article manufacturing. For example, many commercially available disposable absorbent articles utilize a nonwoven topsheet and some may use a nonwoven/film laminate backsheet. And, many of these articles comprise printing on the nonwoven and/or film.

Typically, it is desired for operations like printing to occur at the normal operating speed of the manufacturing line. As such, registration marks are often utilized in conjunction with vision systems to trigger certain operations. Typically, printing may be offset to some extent in a machine direction and to some extent in a cross machine direction. In general, any offset would be passed along to the entirety of the print design such that the entire print design would be offset. So as long as the offset in either the machine direction or the cross machine direction was not too great, the print design would appear in tolerance with respect to the article.

However, where printing is desired to be based upon particular features of the article, there is increased complexity. For example, where the printing is desired to coincide with the features, an offset between the printing and the feature could impact functionality and/or falsely highlight features which are not desired. As a specific example, where printing is desired to coincide with apertures in a topsheet of an article, any offset in the machine direction and/or cross machine direction can cause the printing to be offset from the aperture.

Based on the foregoing, there is a need for a process which can effectively deposit compositions based upon particular features on the web or vice versa.

SUMMARY OF THE INVENTION

The present invention provides systems and methods for non-contact printing compositions on a web. In some forms of the present invention, an inspection/print station is provided which can detect one or more features. With such forms, one or more composition sites may be provided to a web in accordance with a pre-rendered print pattern which most closely correlates to one or more detected features. In addition to or independently from the foregoing, one or more detected features may be provided to a web which correlates to one or more composition sites. In addition to or independently from the foregoing, the inspection/print station may detect one or more features and generate a print pattern based upon the one or more detected features. Additional forms of the present invention are described herein

DETAILED DESCRIPTION OF THE INVENTION

Figure 1A:
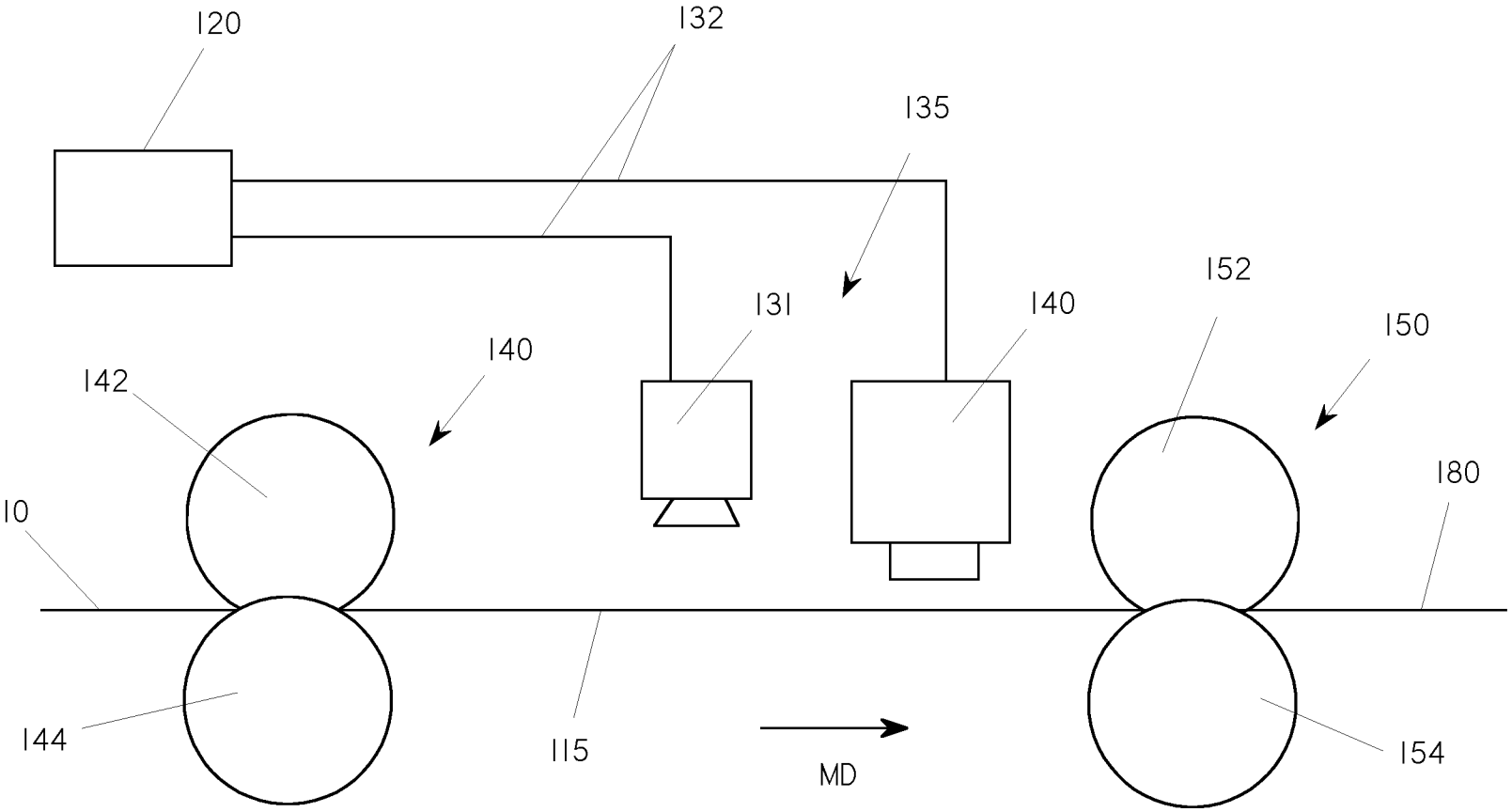
FIG. 1A is a schematic diagram showing a process in accordance with the present disclosure.

The systems and methods of the present invention can facilitate printing of a composition or a plurality of compositions correlating to a plurality of intermediate features and/or discontinuities on a web. For the purposes of the present disclosure, nonwoven webs, film webs, and laminates thereof will be generically referred to as a "web" unless otherwise expressed. And, for the purposes of this disclosure, the term "discontinuity" or "discontinuities" shall refer to apertures which are known in the art.

As used herein "hydrophilic" and "hydrophobic" have meanings well established in the art with respect to the contact angle of a referenced liquid on the surface of a material. Thus, a material having a liquid contact angle of greater than about 90 degrees is considered phobic, and a material having a liquid contact angle of less than about 90 degrees is considered philic. Compositions which are hydrophobic, for example, will increase the contact angle of a referenced liquid (water) on the surface of a material while compositions which are hydrophilic will decrease the contact angle of a referenced liquid (water) on the surface of a material. Notwithstanding the foregoing, reference to relative hydrophobicity or hydrophilicity between material(s) and/or composition(s) does not imply that the material or composition are hydrophobic or hydrophilic. For example, a composition may be more hydrophobic than a material. In such a case neither the composition nor the material may be hydrophobic; however, the contact angle of water droplets on the composition is greater than that of water droplets on the material. As another example, a composition may be more hydrophilic than a material. In such a case, neither the composition nor the material may be hydrophilic; however, the contact angle with respect to water droplets exhibited by the composition may be less than that exhibited by the material.

As used herein the term "print file" shall mean any streamed or batched electronic sequence provided to a printer such that all required rendering and formatting has been completed sufficient to allow the printer to execute a print pattern without further prerequisite processing or rendering. Various printers may require that the sequence be provided in specific formats. The sequences may have proprietary layers for either the protocols or the physical layers. Common examples include USB, USB 3.0, USB 3.1, Ethernet 10/100, Ethernet IP, GigE, CameraLink, CoaxExpress, LVDS, TTL, RS485, RS422, and Serial Comm; however, the printer may require its own unique protocols instead of industry common protocols.

The process pertains to the deposition of compositions onto a web. The composition deposition may include a plurality of composition sites which are based upon intermediate features and/or discontinuities. In some forms however, at least one composition site may be deposited on a web prior to the formation of the intermediate feature and/or the discontinuity. For example, in some forms of the present invention, one or more composition sites may be deposited on a web based on a plurality of intermediate features on the web. Subsequently, the intermediate features may become discontinuities via subsequent manipulation of the web. In other forms of the present invention, one or more composition sites may be deposited onto a web based on a plurality of discontinuities on the web. Still in other forms of the present invention, one or more composition sites may be deposited on a web and one or more intermediate features and/or one or more discontinuities may be provided to the web based on the one or more composition sites.

FIG. 1A depicts an exemplary process for carrying out a method of the present invention. The process shown in FIG. 1A allows for the deposition of one or more composition sites prior to the formation of a discontinuity in a web. As shown, in some forms of the present invention, a precursor web 10 may be provided to a first unit operation 140. As noted above, the precursor web 10 may comprise a nonwoven web, a film web, or a laminate created therefrom, e.g. nonwoven/nonwoven, film/film, nonwoven/film, or the like. Exemplary materials for precursor webs 10 are discussed hereafter.

In some forms of the present invention, the first unit operation 140 may comprise a patterned calendar roller 142 and a smooth anvil roller 144. One or both of the patterned calendar roller 142 and the smooth anvil roller 144 may be heated and the pressure between the two rollers may be adjusted by known techniques to provide the desired temperature, if any, and pressure to concurrently weaken and melt-stabilize (i.e., overbond) the precursor web 10 at a plurality of locations forming a plurality of intermediate features 110 (See FIG. 1B). At the first unit operation 140, the precursor web 10 is transformed into an intermediate web 115 (See FIG. 1B).

Figure 1B:
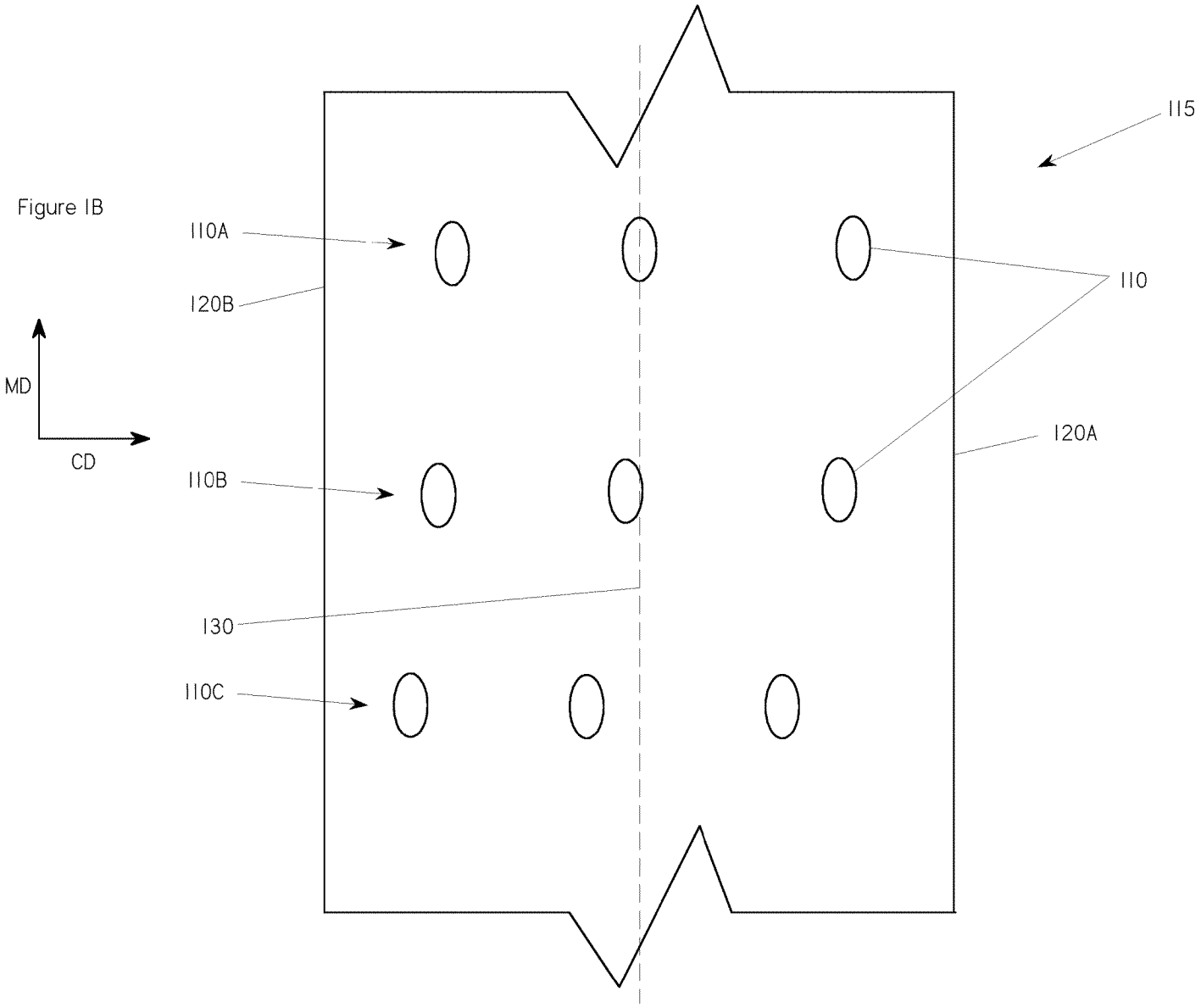
FIG. 1B is a plan view of an exemplary intermediate web constructed in accordance with the present disclosure.

Referring to FIGS. 1A and 1B, subsequent to this first unit operation 140, the intermediate web 115 may comprise the intermediate features 110 arranged in a plurality of groups, 110A, 110B, and 110C. As shown, the intermediate web 115 may comprise side edges 120A and 120B each of which extend generally parallel to a machine direction ("MD"). A cross machine direction ("CD") extends generally perpendicular to the MD and in the same plane as the MD and the intermediate web 115. Forms of the present invention are contemplated where at least one intermediate feature 110 is formed in the intermediate web 115.

As shown, the intermediate features 110 may comprise a phase shift with respect to a machine centerline 130. For example, the intermediate features 110 comprised by a first group 110A may be positioned at a phase shift of zero degrees. This means that the intermediate features 110 are positioned where they were intended to be with respect to the intermediate web 115. However, as noted previously, due to web tracking in the CD the intermediate features 110 can be offset to some extent. For example, the intermediate features 110 comprised by a second group 110B may comprise a phase shift of positive 30 degrees as the intermediate features 110 are shifted slightly to the left of the machine centerline 130. As another example, the intermediate features 110 comprised by a third group 110C may comprise a phase shift of positive 45 degrees as the intermediate features 110 are shifted to the left of the machine centerline 130 to a greater extent than the intermediate features 110 of the second group 110B. The phase shift may comprise a negative value as well. For example, where the intermediate features 110 are shifted to the right of the machine centerline 130, these intermediate features 110 would comprise a negative phase shift, e.g. negative 15 degrees.

It is worth noting that the machine centerline 130 is a fixed reference. The intermediate features 110 and/or discontinuities described herein are not required to straddle the centerline. For example, as shown in FIG. 1B, the intermediate features 110 may be—by design—spaced from the machine centerline 130. In such cases, the intermediate features would be evaluated regarding their predetermined location from the centerline. Any offset from the predetermined location would be evaluated as a phase shift of greater than or less than zero.

While FIG. 1A depicts a unit operation 140 which creates intermediate features, a web comprising intermediate features may be obtained from a supplier. For example, a manufacturer could obtain a web comprising melt stabilized areas, e.g. overbonds, provided by a web supplier. In such instances, the need for the first unit operation 140 would be reduced if not eliminated.

Referring again to FIGS. 1A and 1B, the intermediate web 115 may pass through an inspection/print station 135. As shown, inspection/print station 135 may comprise a camera 131 which is in signal communication 132 with a computational device 120 and a printer 140 in signal communication with the computational device 120. An image captured by the camera 131 can vary. For example, the camera 131 can capture an image of the first group 110A of intermediate features 110. As another example, the camera 131 can capture an image(s) of the first group 110A, the second group 110B, and/or third group 110C of intermediate features 110. In some forms, the camera 131 may capture an image of at least a portion of the first group 110A, second group 110B and/or third group 110C of intermediate features 110.

The camera 131 may transmit the image of the first group 110A, the second group 110B and/or the third group 110C, or at least a portion(s) thereof, to the computational device 120. The computational device 120 analyzes the transmitted image or images provided by the camera 131 to detect the intermediate features of the submitted image(s) and determine the phase shift of the first group 110A, the second group 110B, and/or the third group 110C of intermediate features 110. The determination of phase shift is discussed hereafter.

After the determination of the phase shift of the first group 110A, second group 110B and/or third group 110C, the computational device 120 may compare the determined phase shift to a plurality of stored pre-rendered patterns. For example, in some forms of the present invention, the computational device 120 may comprise a stored pattern for a positive 15 degree phase shift, a negative 15 degree phase shift, a positive 30 degree phase shift, a negative 30 degree phase shift, a positive 45 degree phase shift, a negative 45 degree phase shift, a positive 60 degree phase shift, a negative 60 degree phase shift, a positive 75 degree phase shift, a negative 75 degree phase shift, a positive 90 degree phase shift, a negative 90 degree phase shift, and so on up to 180 degrees (positive and negative). The phase shift increments described above may be increased or reduced. For example, the computational device 120 may comprise stored patterns corresponding to phase shifts of 12 degrees, 13 degrees, 14 degrees, etc. This may ensure that the tolerance of the printed composition associated with the intermediate features 110 is relatively high. In another example, the increment between adjacent phase shift patterns may be increased, e.g. phase shift of 15 degrees, 30 degrees, 45 degrees, etc.

The computational device 120 may then choose which of the stored patterns most closely correlates to the determined phase shift of the first group 110A, second group 110B, and/or third group 110C. The computational device 120 may then provide the chosen stored pattern to the printer 140 for the first group 110A, second group 110B, and/or third group 110C such that composition could be applied to the intermediate web 115. Where the determined phase shift falls between stored patterns, e.g. a phase shift of positive 20 degrees, the computational device 120 may provide the printer 140 with the stored pattern which most closely correlates to the determined phase shift, e.g. positive 15 degrees versus positive 30 degrees.

Accordingly, in some forms, the printer 140 may deposit a first plurality of composition sites according to a first stored pre-rendered pattern. The first plurality of composition sites may be based upon the determined phase shift of the first group 110A of intermediate features 110. The printer 140 may also deposit a second plurality of composition sites according to a second stored pre-rendered pattern. The second plurality of composition sites may be based upon the determined phase shift of the second group 110B of intermediate features 110. In some forms, the first stored pre-rendered pattern may be different than the second stored pre-rendered pattern. Additionally, the printer 140 may also deposit a third plurality of composition sites according to a third stored pre-rendered pattern. The third plurality of composition sites may be based upon the determined phase shift of the third group 110C of intermediate features 110. In some forms, the first stored, pre-rendered pattern, the second stored, pre-rendered pattern, and/or the third stored, pre-rendered pattern may be different.

In some forms, the stored pre-rendered patterns may provide one or more compositions sites which are registered with the intermediate features. In some forms, the pre-rendered patterns may provide one or more composition sites which are offset from the intermediate features. In some forms, the stored pre-rendered patterns may provide one or more composition sites which partially overlap intermediate features. In some forms, a combination of configurations may be provided to the composition sites. For example, a stored pre-rendered pattern may provide a first composition site registered with a first intermediate feature while a second composition site is offset from the first intermediate feature, and/or while a third composition site partially overlaps a third intermediate feature. In addition to the foregoing or independent therefrom, in some forms, the stored pre-rendered patterns may provide one or more composition sites which are disposed between adjacent groups of intermediate features.

Figure 1C:
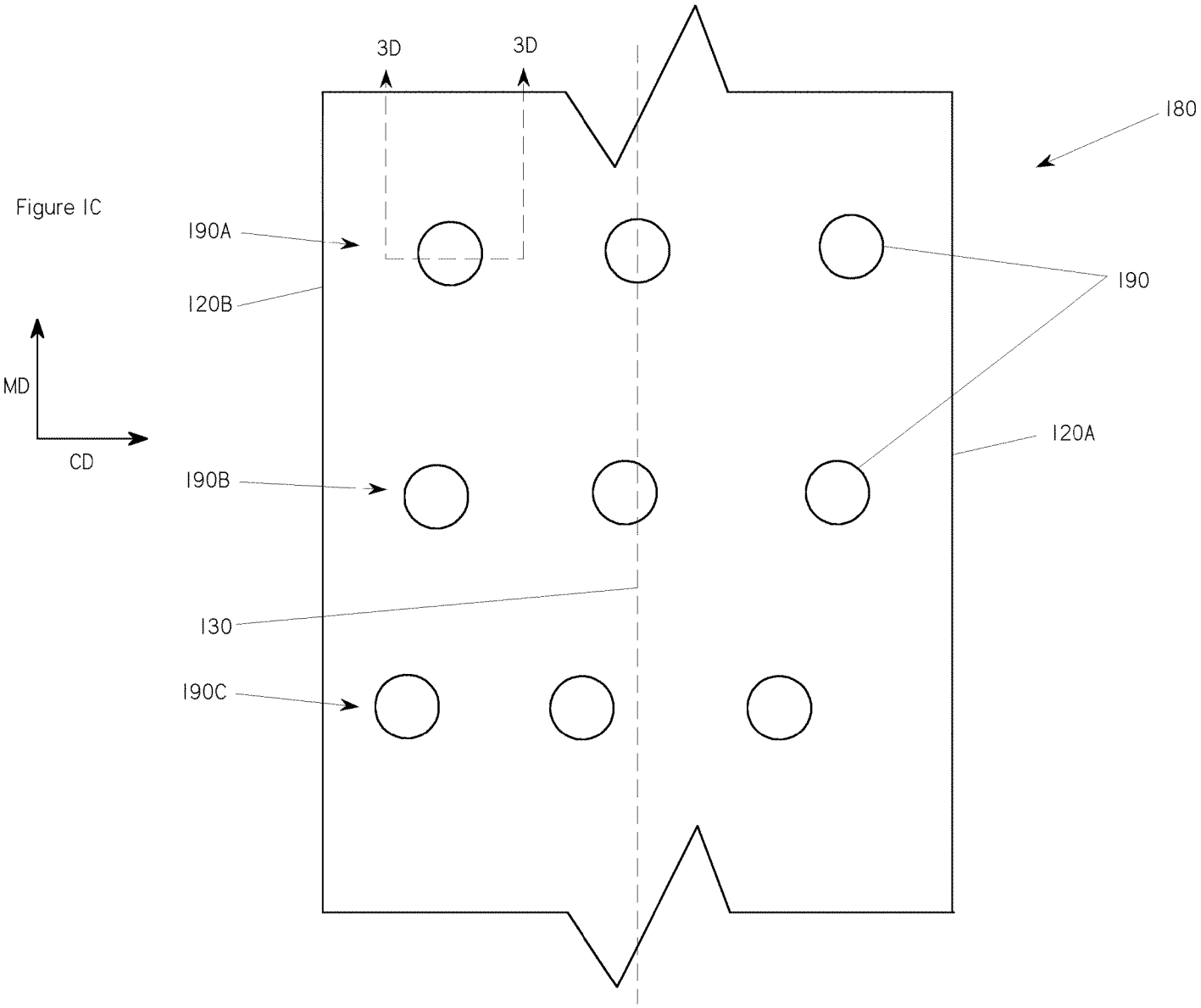
FIG. 1C is a plan view of an exemplary secondary web constructed in accordance with the present disclosure.

Referring to FIGS. 1A-1C, after the deposition of the composition(s) onto the intermediate web 115, the intermediate web 115 may experience a second unit operation 150 which transforms the intermediate features 110 into discontinuities 190. For example, the second unit operation 150 may comprise an incremental stretching system comprising two complimentary rolls 152 and 154 which intermesh with one another and stretch the intermediate web 115. The stretching of the intermediate web 115 can cause the intermediate features 110 to rupture/break apart into discontinuities 190, e.g. apertures, and form a secondary web 180. As shown, the discontinuities 190 may be arranged in groups similar to that of the intermediate features 110, e.g. 190A, 190B, 190C.

Figure 2:
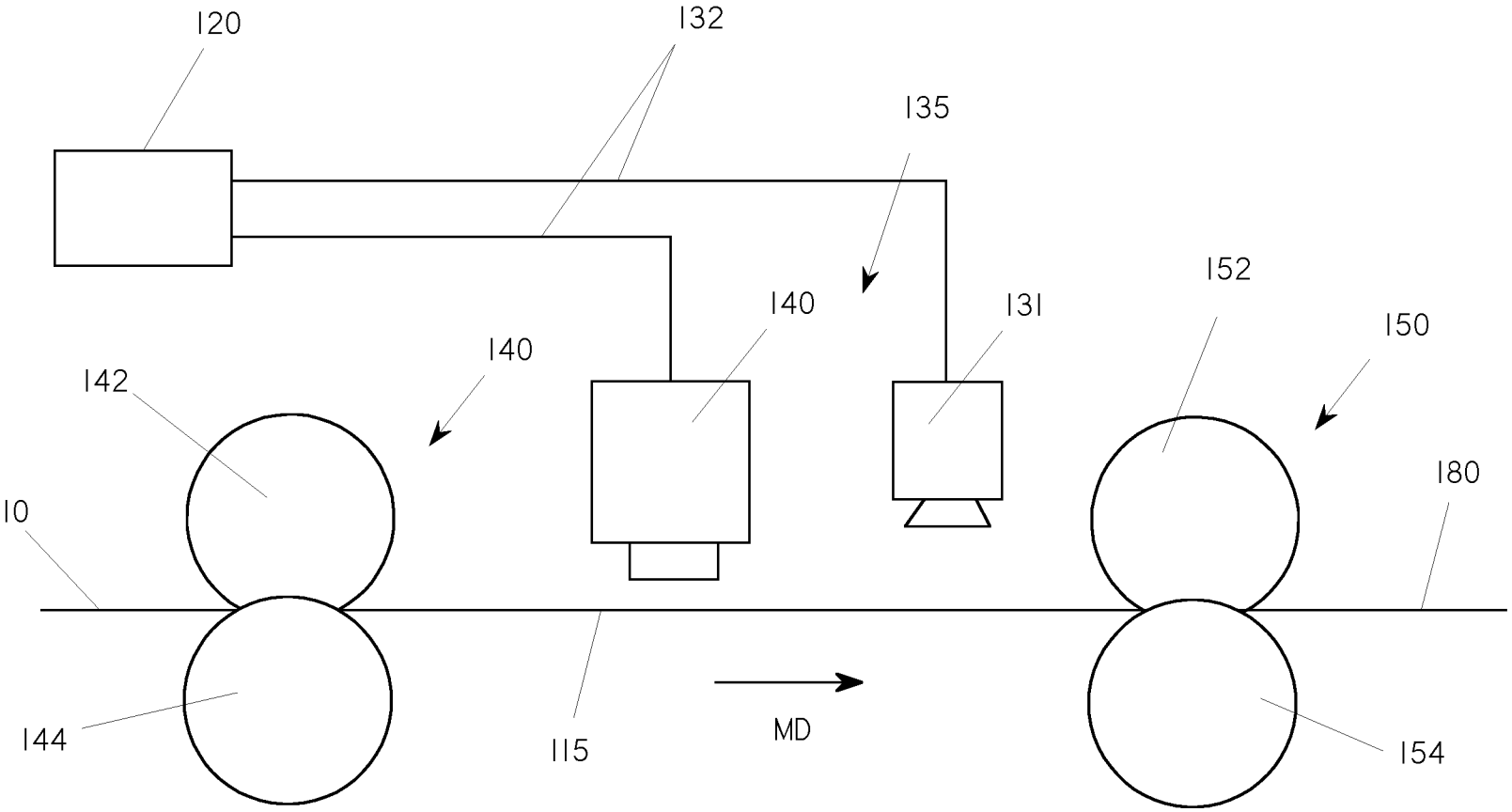
FIG. 2 is a schematic diagram showing another process in accordance with the present disclosure.

Referring now to FIG. 2, the inspection/print station 135 may be provided in a variety of configurations. For example, the camera 131 may be positioned downstream of the printer 140. In such arrangements, the camera 131 may capture an image or images of the intermediate web 115 with the composition disposed thereon. The image or images may be provided to the computational device 120 to analyze whether the composition is phase shifted to the same or close to the same extent as the intermediate features 110 (shown in FIG. 1B). Utilizing the image or images from the camera 131, the computational device 120 could adjust any discrepancy between the phase shift of the intermediate features 110 and the phase shift of the composition deposited on the intermediate web 115. In another example, the camera 131 may be positioned downstream of the second unit operation 150. In such configurations, the camera 131 can provide an image or images to the computational device 120 to determine the phase shift of the discontinuities 190 (See FIG. 1C) versus the phase shift of the composition on the secondary web 180. In such configurations however, detecting the composition on the intermediate web 115 and/or secondary web 180 (See FIGS. 1B and 1C, respectively) may require special lighting or excitation devices such that the composition can be highlighted in the image or images provided to the computational device 120. The inspection/print station 135 is discussed further hereafter.

Figure 3A:
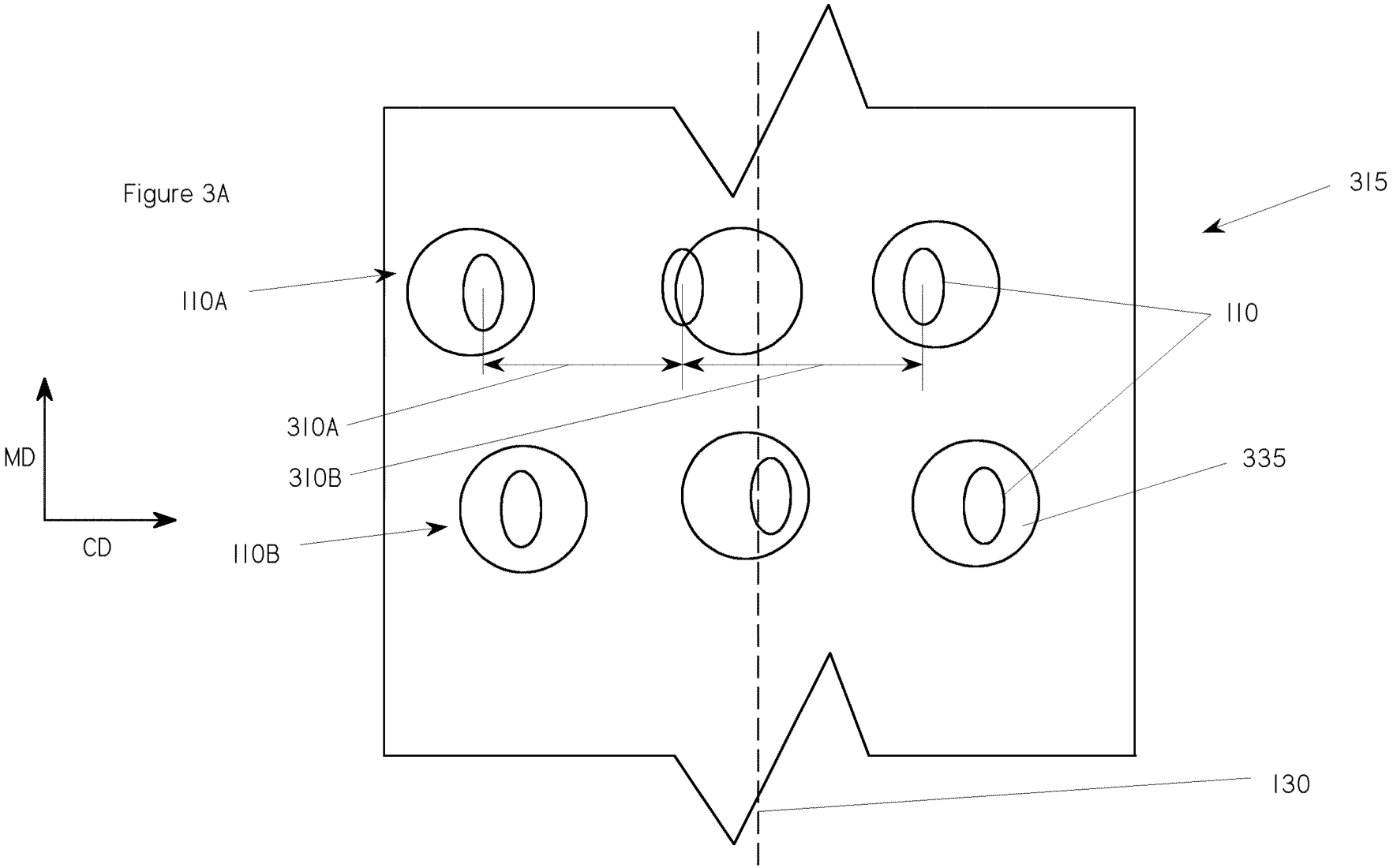
FIG. 3A is a plan view of another exemplary intermediate web constructed in accordance with the present disclosure.

In addition to determining the phase shift of the intermediate features 110, discontinuities 190, and/or the composition associated therewith, the periodicity of the intermediate features 110 may be determined by the computational device 120. For example, as shown in FIG. 3A, an intermediate web 315 is shown comprising an array of intermediate features 110 arranged in groups, e.g. 110A and 110B. While each of the first group 110A and second group 110B may comprise a phase shift with respect to the machine centerline 130, the intermediate features 110 within the first group 110A and the second group 110B may comprise a non-uniform period. For example, where a first distance 310A between adjacent intermediate features 110 (distance between adjacent geometric centers of the features 110) is shorter than a second distance 310B between different adjacent intermediate features 110, the period of the intermediate features 110 of the first group 110A is variable. In such instances, the computational device 120 may determine the periodicity of the first group 110A of intermediate features 110 and provide a signal to the printer 140 (See FIG. 1A) allowing for composition sites 335 larger than their respective intermediate features 110. In some forms, one or more of the composition sites 335 may be larger than their respective intermediate features, while one or more of the composition sites 335 may be smaller than their respective intermediate features.

For example, where the period between adjacent intermediate features 110 is not variable, composition sites 335 having an area of 1.27 square mm may be applied to the intermediate features 110 which have an area of 1.27 square mm. In such constructions, the composition sites 335 may comprise the same length and width dimensions as the intermediate features 110. If desired, the composition sites 335 may be increased such that either the length, width, and/or area are greater than the length, width, and/or area of the intermediate features 110. Or, if desired, dimensions of the composition sites 335 may be decreased such that either the length, width, and/or area of the composition sites 335 is less than the length, width, and/or area of the intermediate features 110.

Where the period of the intermediate features 110 is variable, the composition sites 335 may be modified as well. For example, where the period between adjacent intermediate features 110 in the first group 110A vary by ±2 mm, the composition sites 335 may comprise a width which is 4 mm larger than the width of the intermediate features 110. The increase in width of the composition sites 335 can ensure that each of the intermediate features 110 of the first group 110A receive composition. Similarly, if the period of the intermediate features 110 in the second group 110B vary by ±5 mm, the width of the composition site 335 for the second group 110B may be increased by 10 mm.

The composition sites 335 may be applied to the intermediate features 110 where the composition sites 335 have an area of 105 percent of X square mm, where the intermediate features 110 have an area of X square mm. In some forms, the composition sites 335 may comprise an area of 110 percent of X square mm, 115 percent of X square mm, 120 percent of X square mm, 125 percent of X square mm, 130 percent of X square mm, 135 percent of X square mm, 140 percent of X square mm, 145 percent of X square mm, about 150 percent of X square mm, about 175 percent of X square mm, about 200 percent of X square mm, about 225 percent of X square mm, about 250 percent of X square mm, about 275 percent of X square mm, or about 300 percent of X square mm, specifically including all numbers within these ranges and any ranges created thereby. As shown in FIG. 3A, the composition sites 335 can be adjusted to ensure coverage over the intermediate features 110 even where the period of the first group 110A and/or second group 110B is variable.

To accommodate variable periodicity, the stored pre-rendered patterns may comprise periodicity subgroups which have multiple pre-rendered patterns for phase shift. For example, each of the composition sites 335 adjustments mentioned above may have a subgroup comprising the plurality of stored pre-rendered patterns. So, where the period between adjacent intermediate features 110 in the first group 110A vary by ±2 mm, a first plurality of stored pre-rendered patterns corresponding to composition sites 335 that are at least 4 mm wider than the intermediate features 110 may be stored in the computational device. The first plurality of stored pre-rendered patterns for the above period variability of ±2 mm may include, for example, patterns which accommodate a phase shift of about positive 15 degrees, negative 15 degrees, positive 30 degrees, negative 30 degrees, positive 45 degrees, negative 45 degrees, positive 60 degrees, negative 60 degrees, a positive 75 degrees, a negative 75 degrees, positive 90 degrees, a negative 90 degrees, and so on up to 180 degrees (positive and negative). Similarly, where the period between adjacent intermediate features 110 in the first group 110A vary by ±5 mm, a second plurality of stored pre-rendered patterns corresponding to composition sites 335 that are at least 10 mm wider than the intermediate feature 110 may be stored in the computational device. The plurality of stored pre-rendered patterns for the above period variability of ±5 mm may include, for example, patterns which accommodate a phase shift of about positive 15 degrees, negative 15 degrees, positive 30 degrees, negative 30 degrees, positive 45 degrees, negative 45 degrees, positive 60 degrees, negative 60 degrees, a positive 75 degrees, a negative 75 degrees, positive 90 degrees, a negative 90 degrees, and so on up to 180 degrees (positive and negative). Additional subgroups accommodating additional variability in the period of the intermediate features 110 are contemplated. And, each of the subgroups may comprise the plurality of stored patterns accommodating phase shift as described above. And as provided above, the degrees difference between the phase shift patterns can be increased or decreased depending on the level of accuracy desired. In some forms, the stored pre-rendered patterns may comprise phase shift subgroups which have multiple pre-rendered patterns for periodicity.

In some forms, the intermediate features and/or discontinuities in the image may be dilated and/or eroded to ensure adequate application of the composition sites. For example, the intermediate features and/or discontinuities of an image may be dilated by plus 1 mm such that the composition sites are plus 1 mm larger in all dimensions than the intermediate features and/or discontinuities. The dilation can be any suitable adjustment. For example, the dilation can be in the range of plus 1 mm, 2 mm, 3 mm, 4 mm, 5 mm, 6 mm, 7 mm, 8 mm, 9 mm, specifically reciting all values within these ranges and any ranges formed thereby.

Similar to the intermediate features discussed above, the periodicity of discontinuities may also be determined by the system. For example, referring to FIG. 3B, a secondary web 380 is shown comprising a plurality of discontinuities 390 arranged in groups, e.g. 390A and 390B. The size of the composition sites 335 may be adjusted as previously described.

For those forms where a composition is associated with a discontinuity 390, dimensions and/or areas of the composition sites 335 may be greater than dimensions and/or areas of the discontinuity 390. For example, a width of the composition sites 335 parallel to the CD can be greater than a width of the discontinuity 390 parallel to the CD. Similarly, a length of the composition sites 335 parallel to the MD may be greater than a length of the discontinuity 390 parallel to the MD. Any of the composition sites discussed herein may be configured as described herein.

The intermediate features of the present invention may be any suitable size. Some examples include greater than or equal to about 0.25 square mm, 0.5 square mm, 0.635 square mm, 0.75 square mm, 1.0 square mm, 1.25 square mm, 1.5 square mm, 1.75 square mm, 2.0 square mm, 2.25 square mm, 2.5 square mm, 2.75 square mm, 3.0 square mm, 3.25 square mm, 3.5 square mm, 3.75 square mm, 4.0 square mm, 4.25 square mm, 4.5 square mm, 4.75 square mm, 5.0 square mm, 5.5 square mm, 6.0 square mm, 6.5 square mm, 7.0 square mm, 7.5 square mm, 8.0 square mm, 8.5 square mm, 9.0 square mm, 9.5 square mm, or 10 square mm, specifically including all values within these values and any ranges created thereby.

As noted previously, the stored pre-rendered patterns may provide composition sites which are registered with one or more intermediate features, but this is not a requirement. Regarding the discussion of periodicity, forms of the present invention are contemplated where stored pre-rendered patterns comprise composition sites which are reduced in size based upon the determined periodicity. This aspect may be beneficial where at least one of the composition sites is disposed between adjacent intermediate features. For example, where the period between adjacent intermediate features 110 in a first group 110A varies by ±2 mm, a composition site may comprise a smaller width to accommodate a smaller distance between adjacent intermediate features.

Accordingly, in some forms of the present invention, the printer 140 may deposit a first plurality of composition sites 335 based upon a first group of intermediate features 110A and/or a first group of discontinuities 390A in accordance with a first stored pre-rendered pattern. The printer 140 may also deposit a second plurality of composition sites 335 based upon a second group of intermediate features 110B and/or a second group of discontinuities 390B in accordance with a second stored pre-rendered pattern. In some forms, the first stored pre-rendered pattern and the second stored pre-rendered pattern may be based upon different periodicity and/or different phase shifts of the intermediate features and/or discontinuities.

In some forms of the present invention, the camera 131 may provide images directly to the printer 140. For example, as noted previously, the camera 131 may capture an image or image(s) with respect to the intermediate features and/or discontinuities. The camera 131 may then provide the image(s) directly to the printer 140 as a print file. The printer 140 may then apply compositions to the web in accordance with the image(s) provided by the camera 131. In such forms, there may be no need to have stored pre-rendered patterns for comparison.

Figure 3B:
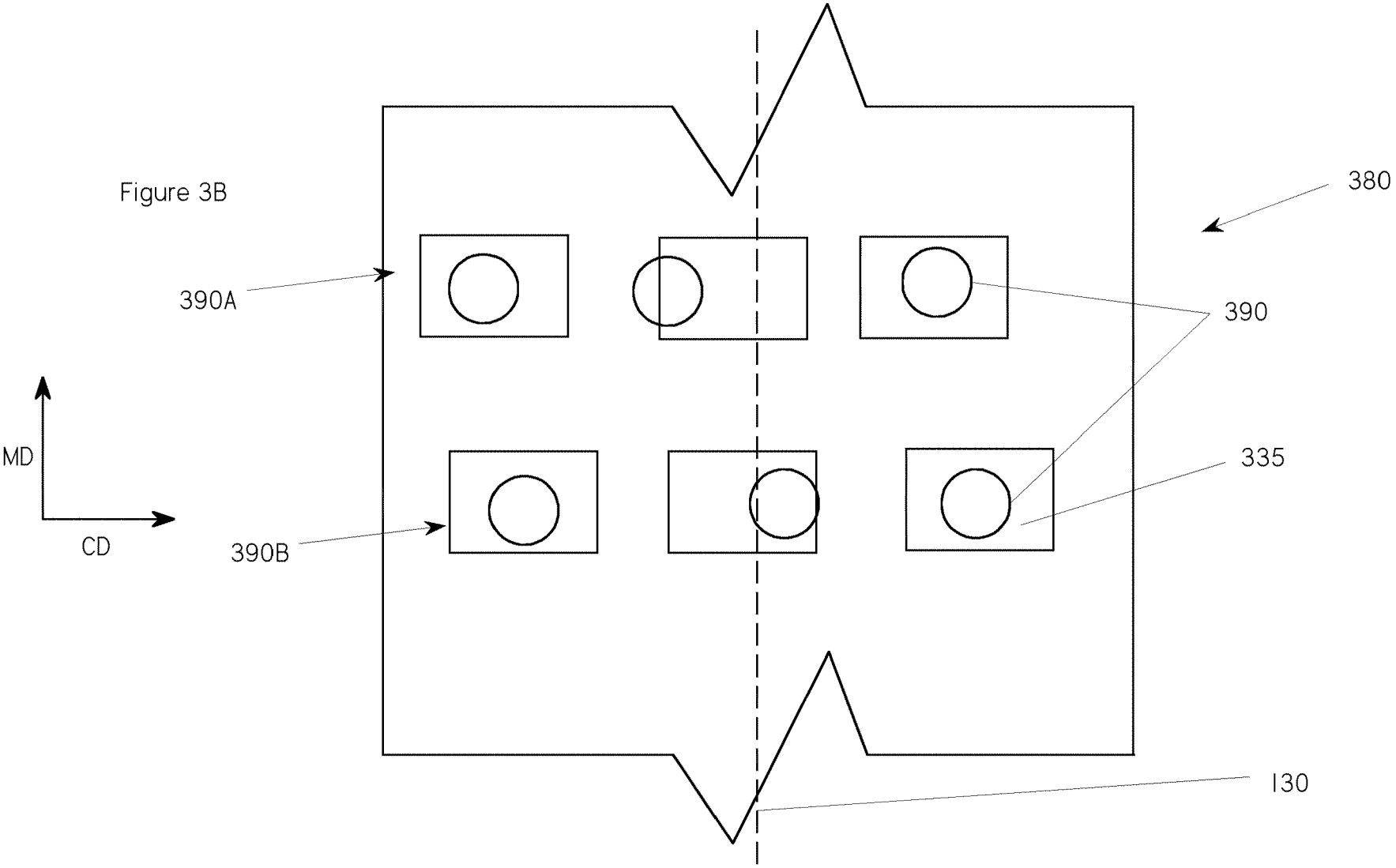
FIG. 3B is a plan view of an exemplary secondary web constructed in accordance with the present disclosure.
Figure 8A:
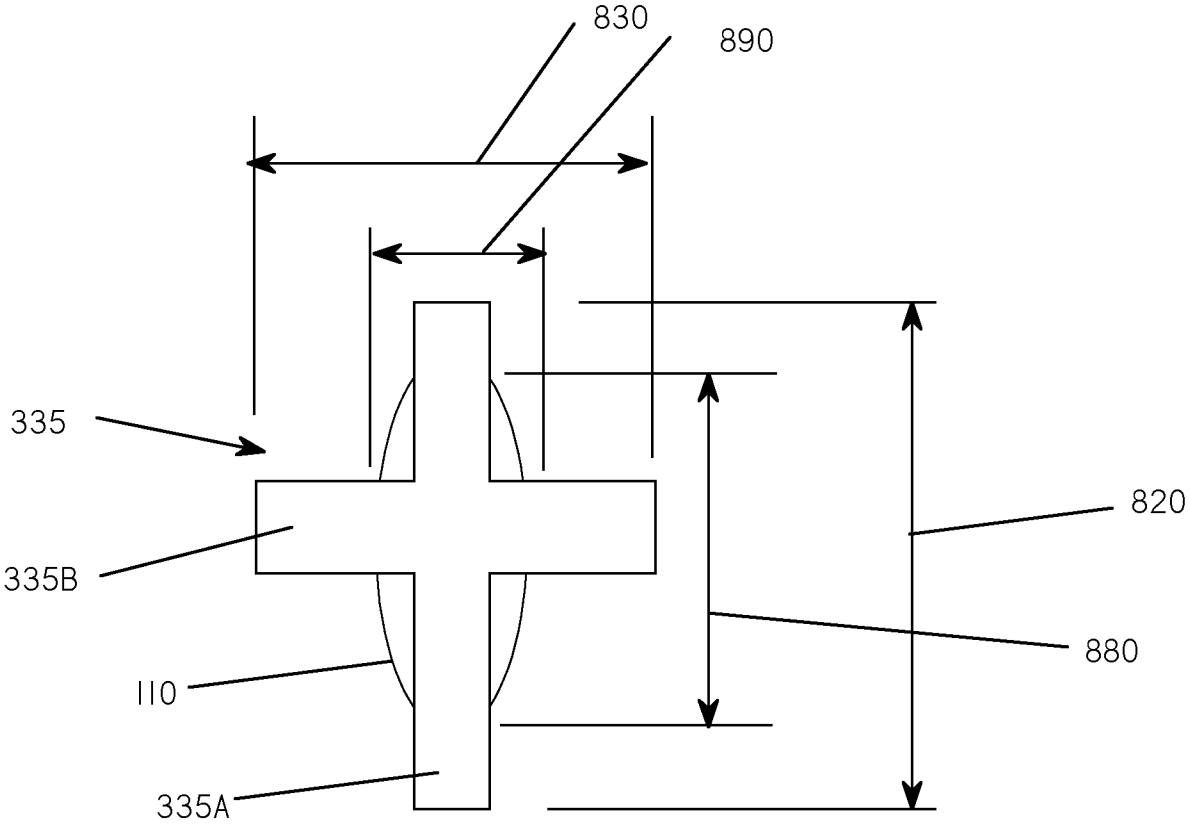
FIG. 8A is a schematic illustration of a composition site of the present invention.
Figure 8A:
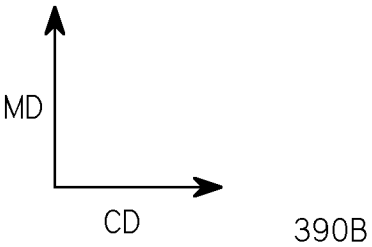

Regardless of whether composition sites 335 are provided to an intermediate web 315 or a secondary web 380, the composition sites 335 may be any suitable shape. For example, while circles are shown in FIG. 3A, rectangles are shown in FIG. 3B. Other suitable shapes include, triangles, ovals, ellipses, stars, flowers, diamonds, hearts, trapezoids, letters, numbers, toroid, the like, and/or combinations thereof. In some forms of the present invention, the composition sites 335 may comprise outlines of shapes. For example, at least some of the compositions sites 335 may comprise the outline of a star. As another example, the composition sites 335 may comprise a star that is filled. These examples are applicable to any shape that is contemplated for the compositions sites 335. Additional exemplary shapes are discussed hereafter with regard to FIGS. 8A and 8B.

Figure 3C:
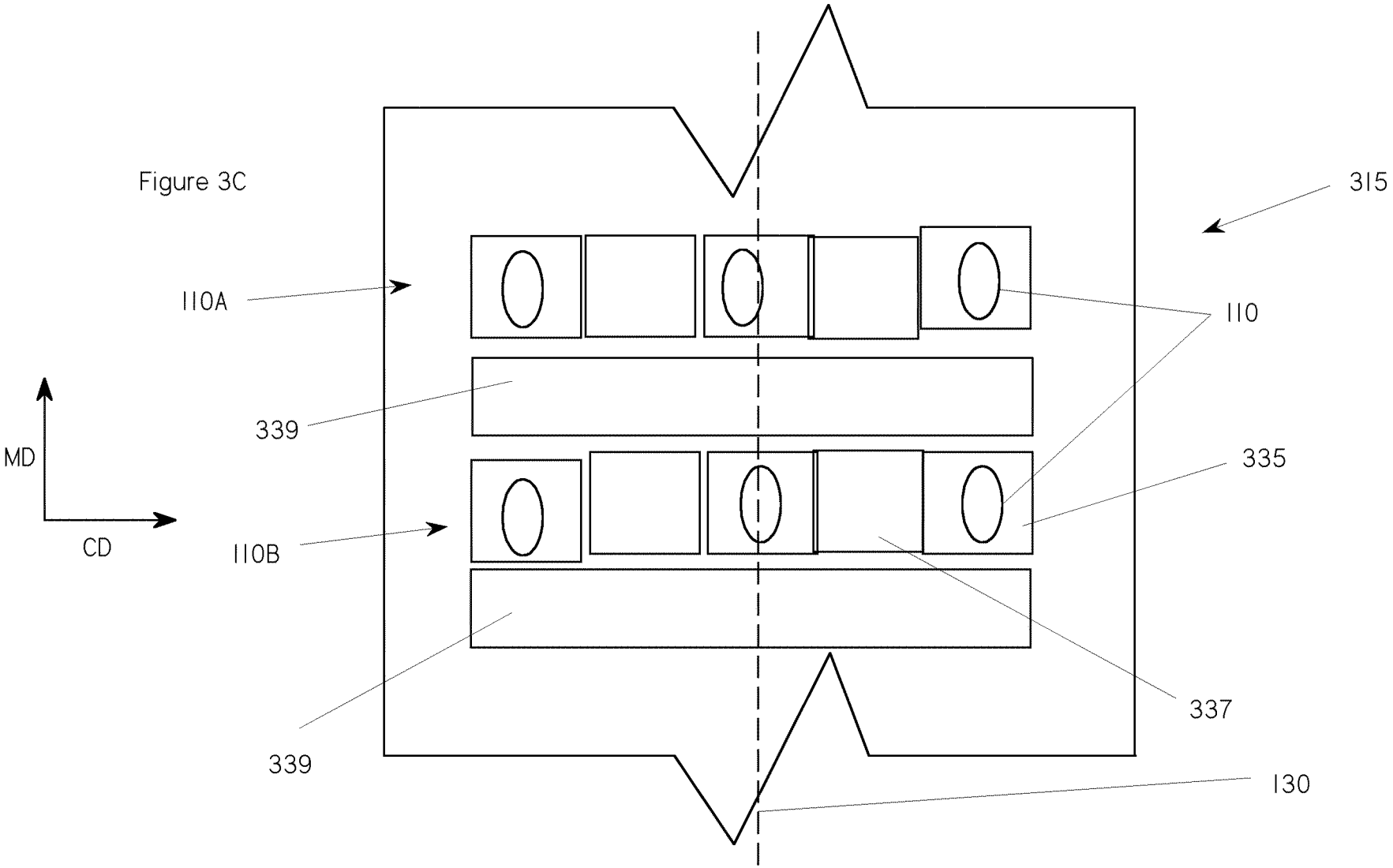
FIG. 3C is a plan view of another exemplary intermediate web constructed in accordance with the present disclosure.

Referring to FIG. 3C, composition sites 335 may be arranged in a variety of configurations on the intermediate web 315 and may be deposited on an intermediate web or a secondary web based upon one or more intermediate features and/or one or more discontinuities. For example, the intermediate web 315 may comprise a plurality of composition sites 335, 337 which are deposited on the intermediate web 315 based upon a plurality of intermediate features 110. As shown, a first plurality of composition sites 337 may be disposed between intermediate features 110. And, a second plurality composition sites 335 may be registered with the intermediate features 110. As shown, the first plurality of composition sites 337 and the second plurality of composition sites 335 may be spaced apart. Or, in some forms of the present invention, the first plurality of composition sites 337 and the second plurality of composition sites 335 may overlap one another.

Still in other examples, the intermediate web 315 may comprise the first plurality of composition sites 337 sans the second plurality of composition sites 335 or vice versa. If desired, additional composition sites may be provided. For example, a third plurality of composition sites 339 may be provided between the first group 110A of intermediate features 110 and the second group 110B of intermediate features 110. And where multiple composition sites, e.g. 335, 337, and/or 339 are provided, multiple compositions may be applied. For example, the first plurality of composition sites 337 may comprise a first composition while the second plurality of composition sites 335 may comprise a second composition which is different from the first composition. Similarly, in some forms, the third plurality of composition sites 339 may comprise a third composition which is different from the first and/or second composition. Or, the first plurality, second plurality, and/or third plurality of composition sites may comprise the same composition but at different basis weights. Secondary webs resulting from the intermediate webs may be similarly configured. The stored pre-rendered patterns discussed heretofore, may correspond to at least one of the first plurality of composition sites, the second plurality of composition sites, and/or the third plurality of composition sites.

Figure 3D:
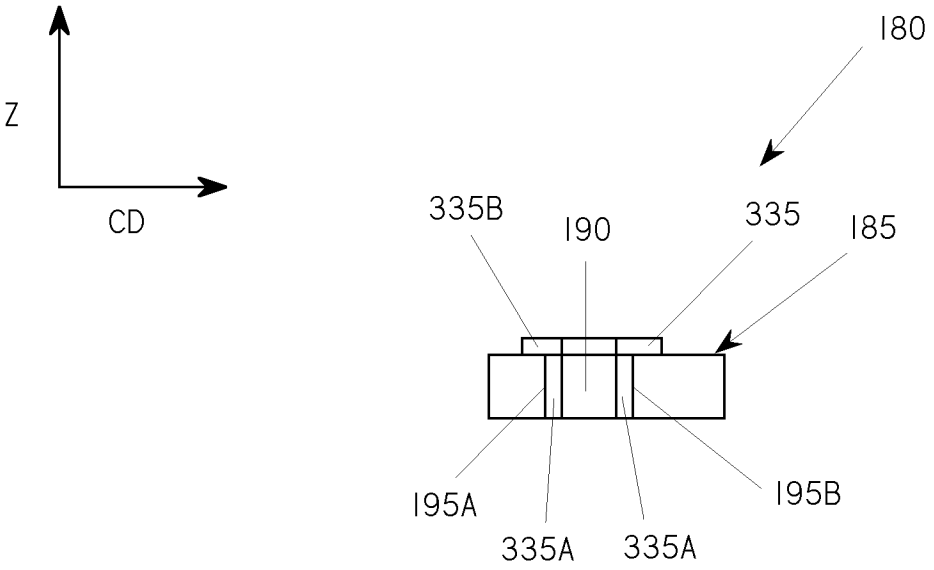
FIG. 3D is an exemplary cross section of a web constructed in accordance with the present disclosure.

Suitable first and second unit operations forming intermediate features 110 and subsequently discontinuities include those unit operations associated with stretch aperturing as described in U.S. Pat. Nos. 5,658,639; 5,628,097; 5,916,661; 7,917,985; and U.S. Patent Application Publication No. 2003/0021951. For such aperturing processes, referring to FIG. 3D, in some forms, the composition sites 335 may comprise a first portion 335A disposed on side walls 195A and 195B of the aperture. Additionally, in some forms, the composition sites 335 may comprise a second portion 335B which is disposed on a first surface 185 of the secondary web 180. The first portion 335A and/or second portion 335B may comprise a plurality of dots or droplets of composition particularly where ink jet printing is utilized. As such, on a microscopic scale, the first portion 335A and/or second portion 335B may appear discontinuous; however, to the naked eye, the first portion 335A and/or second portion 335B may appear continuous. Additional configurations are discussed hereafter.

Other stretch aperturing operations are contemplated and are discussed in additional detail in U.S. patent application Ser. Nos. 14/933,028; 14/933,001; and Ser. No. 14/933,013. In these particular stretch aperturing operations, arrays of apertures can be created forming a pattern or a plurality thereof. In such forms of the present invention, Fourier analysis (discussed hereafter) may not provide the most accurate results particularly in instances where the periodicity between a first group and a second group of apertures varies greatly. Where the periodicity of the intermediate features and/or discontinuities varies greatly, pattern recognition may be a better approach. Each of these analyses—Fourier analysis and pattern recognition—are discussed in further detail below. And, as mentioned previously, in such forms, the camera 131 may provide the image(s) directly to the printer such that the printer may apply composition(s) to the web in accordance with the image(s).

Figure 4A:
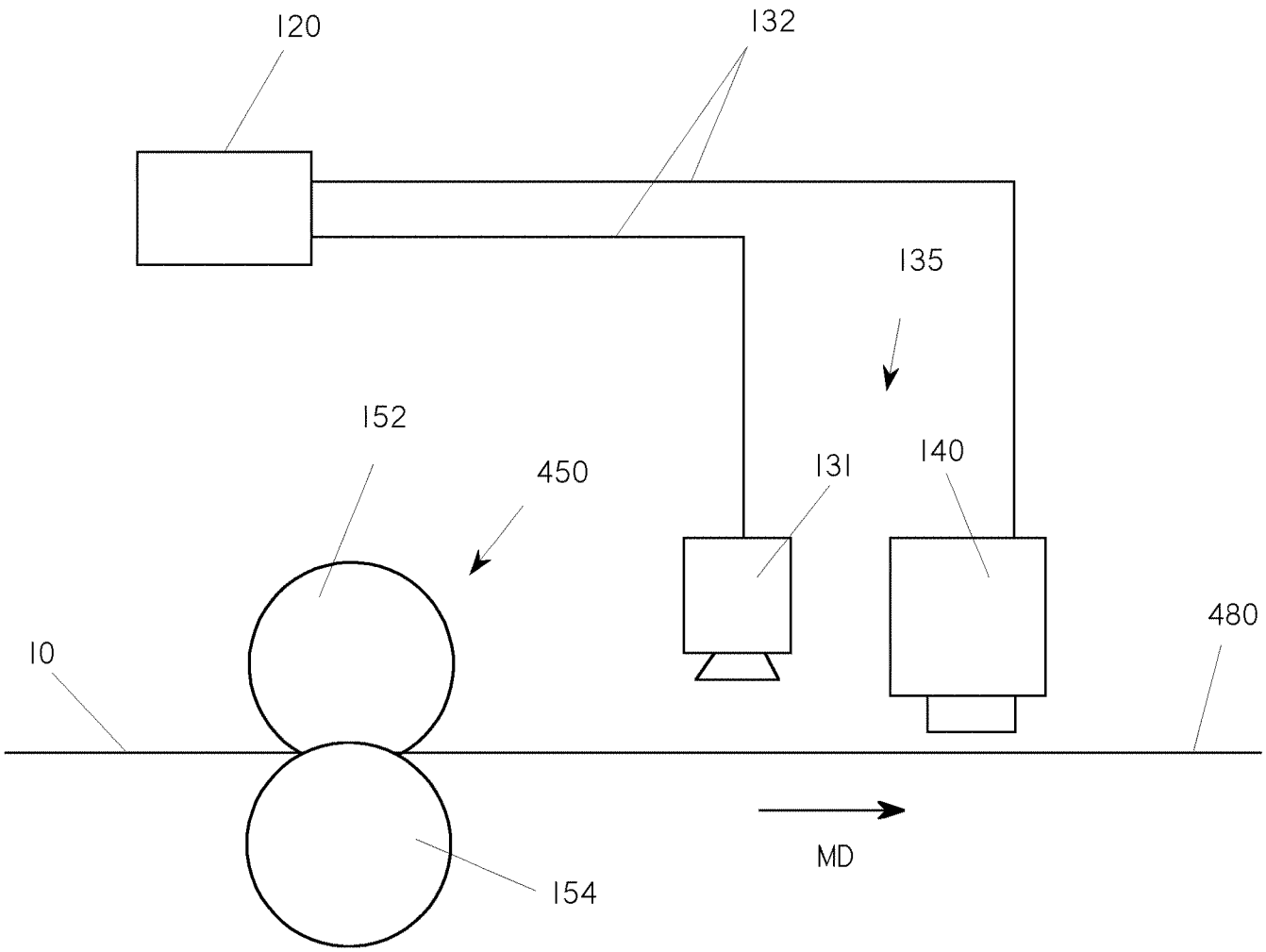
FIG. 4A is a schematic diagram showing a process in accordance with the present disclosure.
Figure 4B:
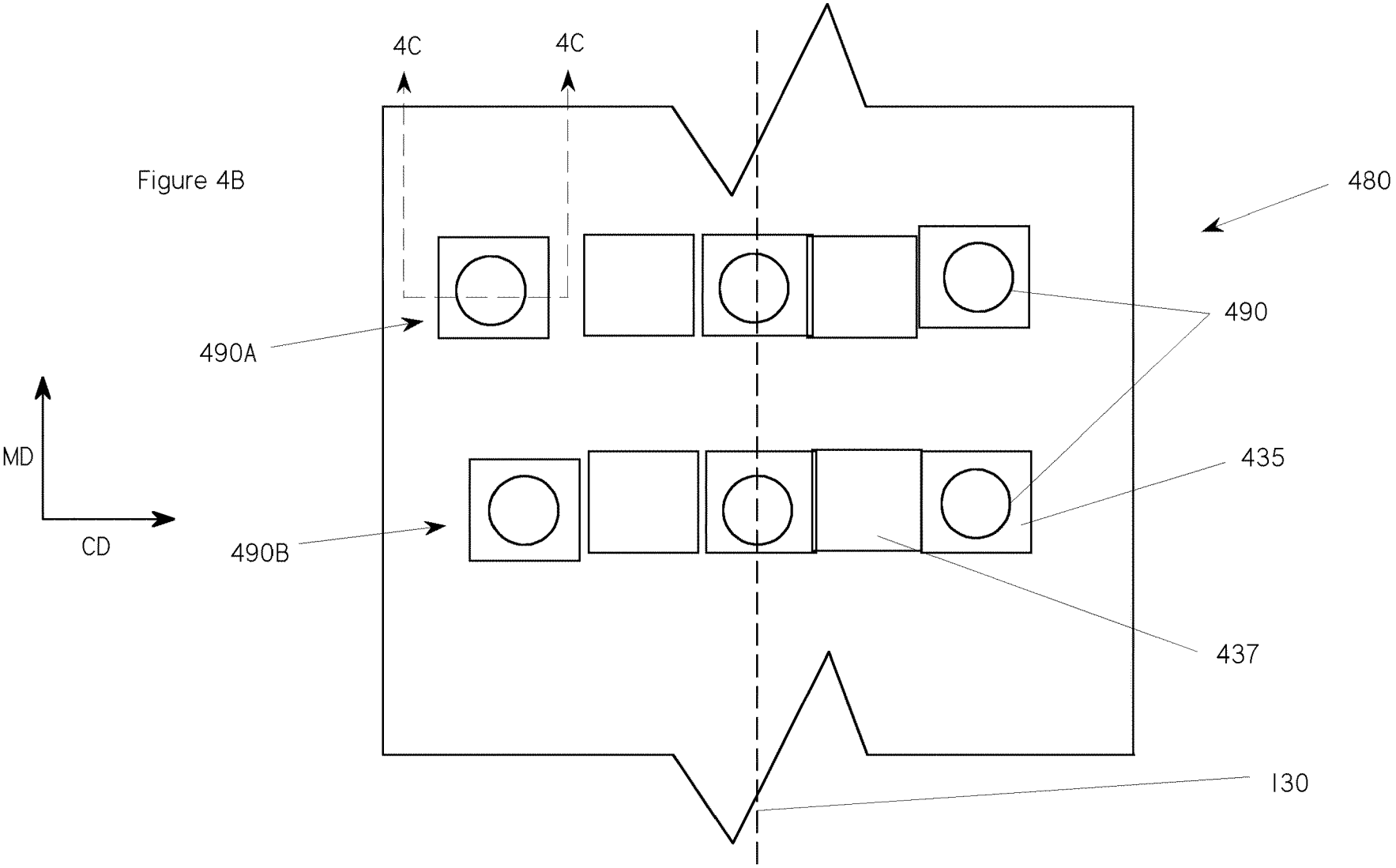
FIG. 4B is a plan view of an exemplary secondary web constructed in accordance with the present disclosure.

While FIG. 1A depicts two unit operations other configurations are contemplated. For example, only one unit operation may occur prior to the web passing through the visual inspection/print station 135. As shown in FIGS. 4A and 4B, a unit operation 450 may manipulate the precursor web 10 thereby producing a secondary web 480 with a plurality of discontinuities 490 therein. The visual inspection/print station 135 may be configured as previously described. For example, the printer 140 may be positioned upstream of the camera 131.

As shown, dimensions and/or areas of a composition site 435 may be greater than dimensions and/or areas of the discontinuity 490. For example, a width of the composition sites 435 parallel to the CD can be greater than a width of the discontinuities 490 parallel to the CD. Similarly, a length of the composition sites 435 parallel to the MD may be greater than a length of the discontinuities 490 parallel to the MD. As noted previously, where a composition is registered with intermediate features, the composition sites may more closely match the dimensions of the resulting discontinuity, particularly where the discontinuity is an aperture. Where the discontinuities 490 comprise apertures, the length of the composition sites 435 may be greater than about 0.5 mm than the length of the discontinuity 490. Similarly, the width of the composition sites 435 may be greater than about 0.5 mm than the width of the discontinuity 490. In some forms, the length and/or width of the composition sites 435 may be greater than about 0.1 mm, greater than about 0.2 mm, greater than about 0.3 mm, greater than about 0.4 mm, greater than about 0.5 mm, greater than about 0.6 mm, greater than about 0.7 mm, greater than about 0.8 mm, greater than about 0.9 mm, or greater than about 1.0 mm than the width of the discontinuity, specifically including all values within each of the above and all ranges created thereby. The composition sites correlating to intermediate features may be sized similarly with regard to the intermediate feature(s).

Figure 4C:
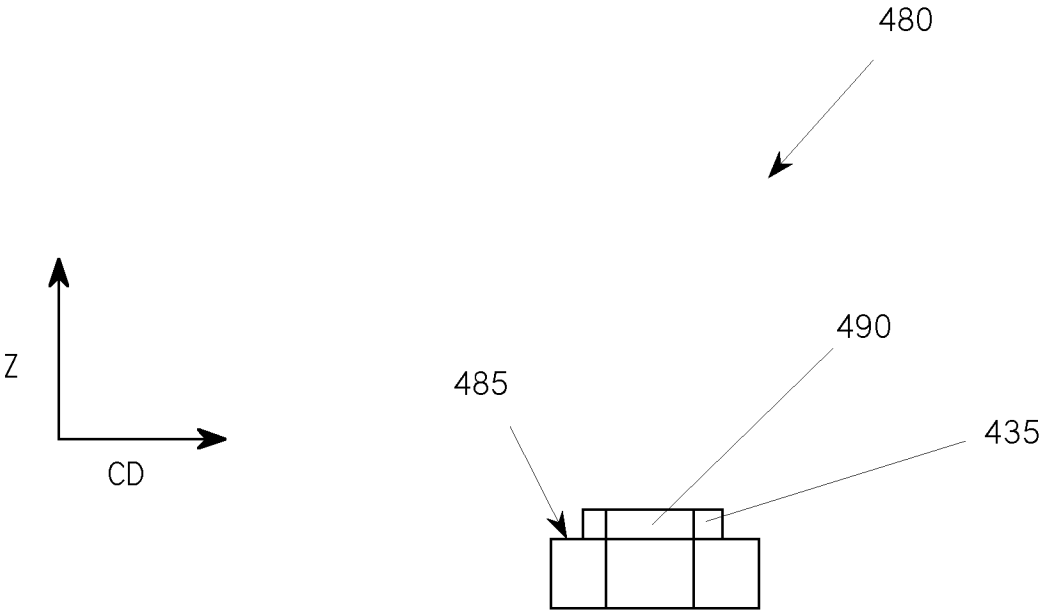
FIG. 4C is an exemplary cross section of a web constructed in accordance with the present disclosure.

In some forms, the width of the composition sites 435 may be greater than its length to accommodate period variability of the discontinuities 490. For those forms of the present invention where an intermediate feature is not provided, the composition sites 435 may be disposed on a first surface 485 of the secondary web 480 as shown in FIG. 4C. Without wishing to be bound by theory, it is believed that while the composition sites 435 may primarily be comprised by the first surface 485 of the secondary web 480, at least a portion of the composition may be provided on sidewalls of the discontinuity 490.

Some suitable processes for forming apertures without creating intermediate features may include those described in U.S. Pat. Nos. 8,679,391 and 8,158,043, and U.S. Patent Application Publication Nos. 2001/0024940 and 2012/0282436. Additional examples include hot pin, punching, die cutting, rotary knife aperturing, etc.

Regardless of how apertures are formed, the apertures may be any suitable shape and/or size. For example, similar to the composition sites discussed heretofore, the apertures may comprise any shape.

Figure 5:
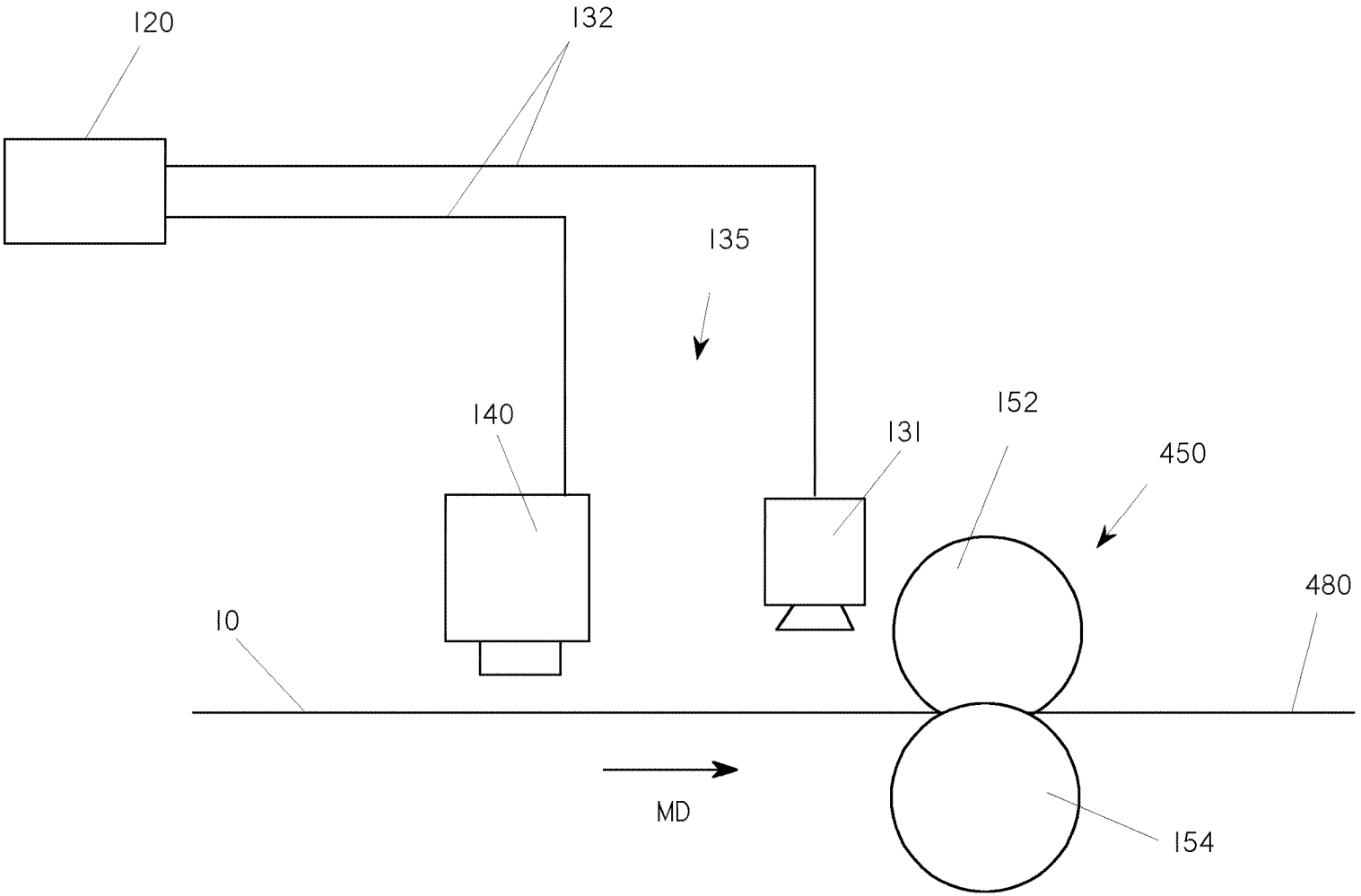
FIG. 5 is a schematic diagram showing a process in accordance with the present disclosure.

Referring to FIG. 5, in some forms of the present invention, one or more composition sites may be provided to the precursor web 10 prior to the formation of intermediate features and/or discontinuities. For example, the printer 140 may deposit a one or more composition sites onto the precursor web 10. The camera 131 may provide an image or images to the computational device 120. The computational device 120 in such forms, may provide feedback to the unit operation 450 either advancing or retarding its timing based upon detected positions of the plurality of composition sites.

The resulting secondary web 480 may comprise one or more composition sites which correspond to one or more intermediate features and/or discontinuities. For example, the one or more composition sites may be registered with the one or more intermediate features and/or discontinuities. As another example, the one or more composition sites may be offset with respect to the one or more intermediate features and/or discontinuities. Yet another example, the one or more composition sites may partially overlap the one or more intermediate features and/or discontinuities. In some forms, the secondary web 480 may comprise a plurality of composition sites where at least some of the plurality of compositions sites are (i) registered with the one or more intermediate features and/or discontinuities; (ii) offset with the one or more intermediate features and/or discontinuities; and/or (iii) partially overlap the one or more intermediate features and/or discontinuities.

In other forms, the camera may be disposed downstream of the unit operation 450. In such forms, the computational device 120 may be in signal communication with the printer 140 and/or the unit operation 450. The computational device 120 may advance and/or retard the printer 140 and/or the first unit operation 450. Additionally, the computational device 120 may also adjust the print pattern based upon the image(s) provided by the camera 131. In such forms, the image(s) provided by the camera 131 may also be utilized by the computational device 120 to determine any offset with the discontinuities and/or the plurality of composition sites in the MD direction.

The phase shift as well as the periodicity of the discontinuities versus the composition sites may be determined as mentioned herein regarding the forms of FIG. 5. For example, the camera 131 may provide an image or images to the computational device 120. The computational device 120 can detect the discontinuities and determine the phase shift and periodicity as described herein. Once the phase shift and periodicity has been determined, the computational device 120 may select a stored pre-rendered pattern from a plurality of patterns which most closely correlates to the phase shift of the discontinuities. Similarly, the computational device 120 may select a pre-rendered pattern from a plurality of patterns which accommodates the periodicity of the discontinuities.

Where the precursor web is manipulated via a first unit operation and a second unit operation, some flexibility can be provided. For example, the first unit operation may create a plurality of intermediate features on an intermediate web. The intermediate web may then be manipulated by a second unit operation which transforms each of the plurality of intermediate features into a plurality of discontinuities. In addition, the second unit operation or a subsequent unit operation can create a second plurality of discontinuities for which no pre-existing intermediate feature was provided.

The apertures may range in size from about Effective Aperture AREA in the range of about 0.1 $mm^2$ to about 15 $mm^2$, 0.3 $mm^2$ to about 14 $mm^2$, 0.4 $mm^2$ to about 12 $mm^2$, 0.3 $mm^2$ to about 10 $mm^2$, 0.5 $mm^2$ to about 8 $mm^2$, or 1.0 $mm^2$ to about 8 $mm^2$, specifically including all 0.05 mm increments within the specified ranges and all ranges formed therein or thereby.

Figure 6A:
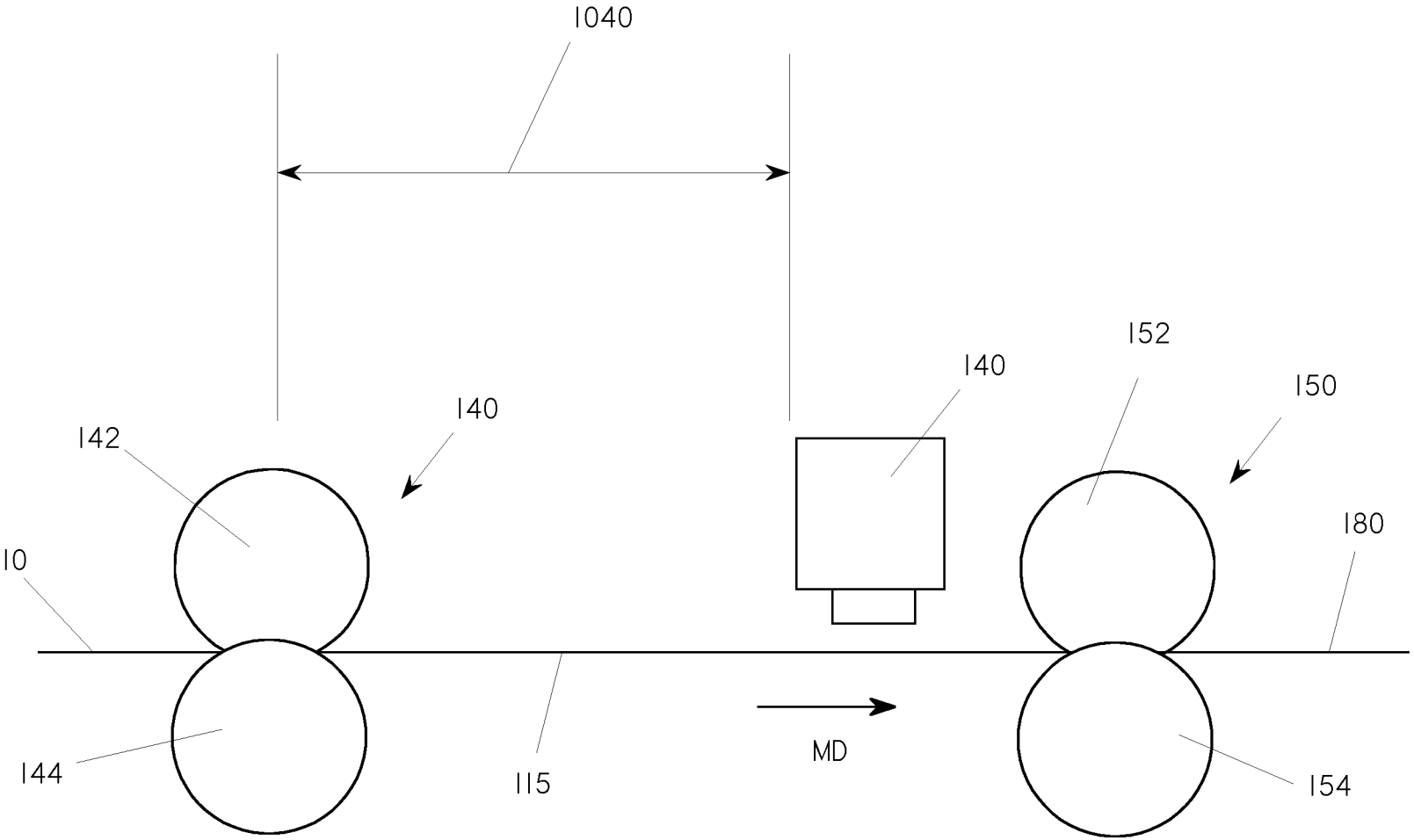
FIGS. 6A-6C are schematic diagrams showing processes in accordance with the present disclosure.

Addition processes are contemplated which do not utilize a visual system. Examples are provided with regard to FIGS. 6A-6C. In some forms of the present invention, compositions may be associated with intermediate features and/or discontinuities without the use of a vision system. For example, as shown in FIG. 6A, the printer 140 may be disposed between the first unit operation 140 and the second unit operation 150. If the printer 140 is positioned within a distance 1040 between the first unit operation 140 and the printer 140, the intermediate web 115 may not track to such an extent that a vision system is needed. In such forms, the step of forming the intermediate features and printing is simply a matter of sequencing.

Figure 6B:
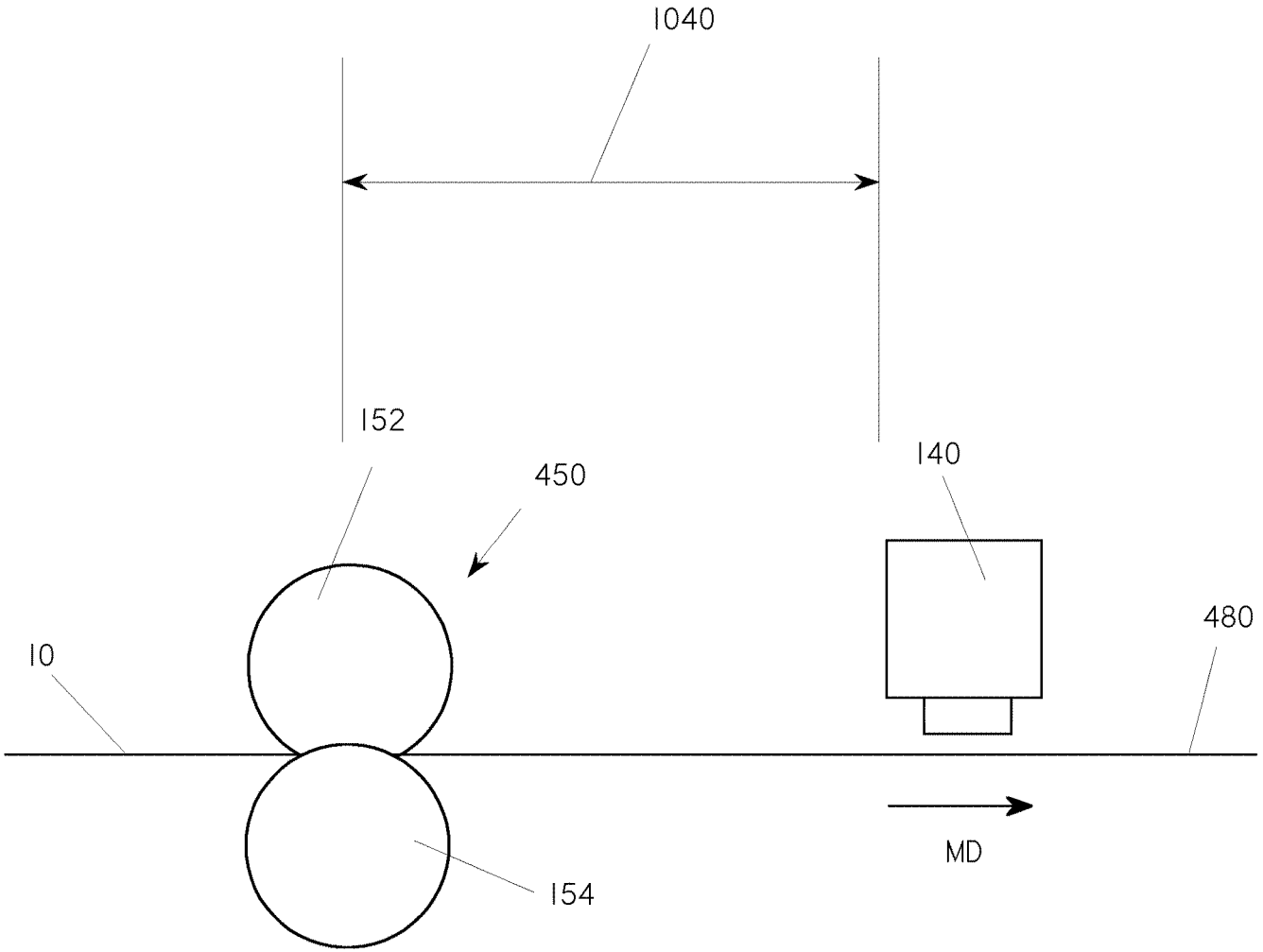
Figure 6C:
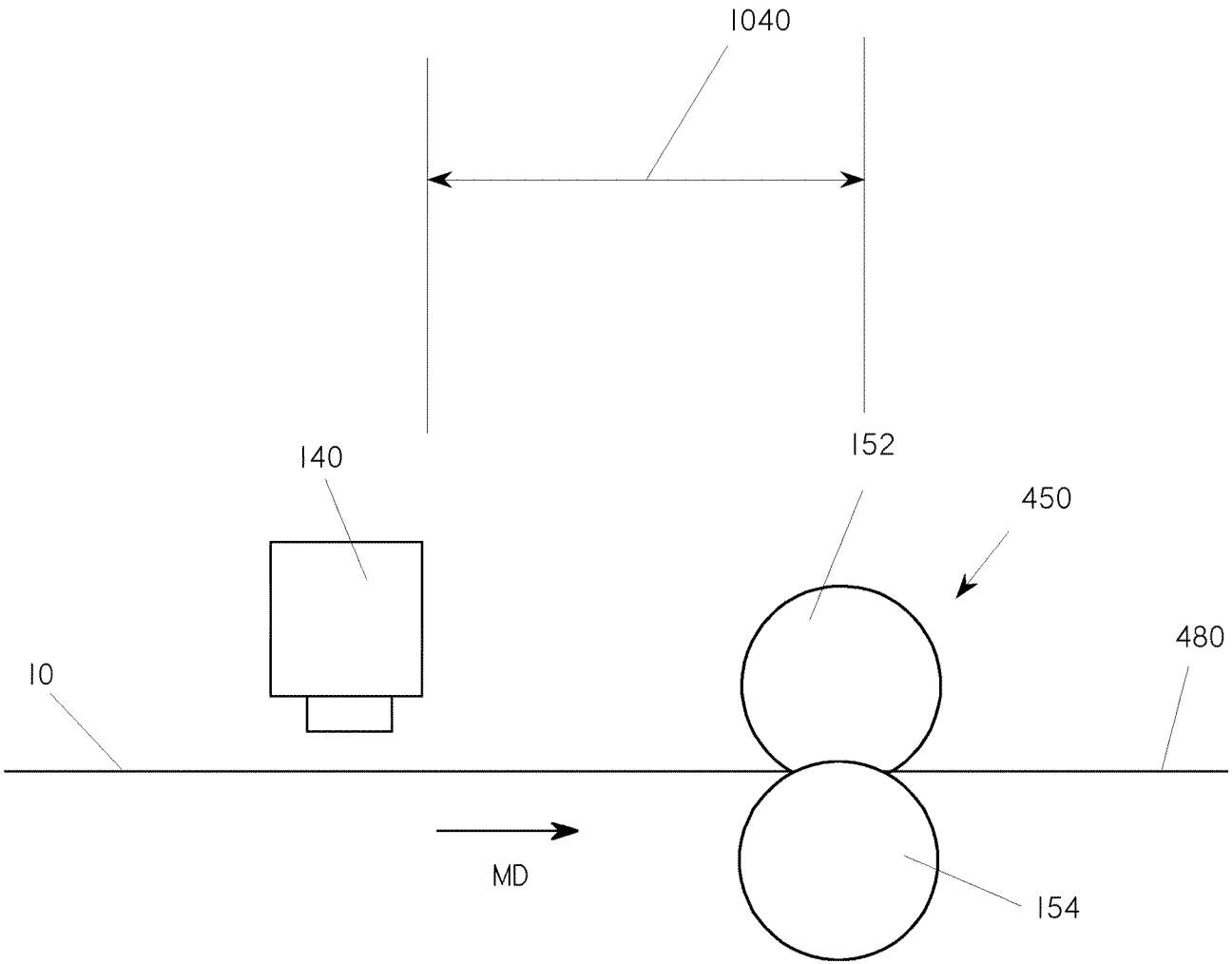

With regard to FIG. 6B, for those forms where a composition or composition(s) are applied to the web post formation of the discontinuities, the printer 140 may be positioned within a distance 1040 of the unit operation 450. Similarly, as shown in FIG. 6C, the printer 140 may be positioned within the distance 1040 upstream of the unit operation 450. In some forms of the present invention, the distance 1040 may be less than 5 times web width in the CD. In some forms, even where the distance 1040 is 5 times the web width in the CD or less, a vision system may still be utilized.

Precursor Web

As discussed previously, the precursor web may comprise a single layer or multiple layers of material. For example, the precursor web may comprise a nonwoven layer. As another example, the precursor web may comprise a film layer. Still in other examples, the precursor web may comprise a laminate which includes multiple nonwoven layers, multiple film layers, or a combination thereof.

The precursor web may comprise any suitable material. Some suitable examples include nonwovens, wovens, cellulosic materials, films, elastic materials, non-elastic materials, high-loft materials, and/or foams. The precursor webs may also comprise one or more layers of one or more nonwoven materials, one or more films, combinations of different nonwoven materials, combinations of different films, combinations of one or more films and one or more nonwoven materials, or combinations of one or more different materials, for example. Precursor webs having one or more layers of the same or similar materials are also within the scope of the present disclosure.

As another example, the precursor web may comprise a layer comprising a plurality of substrates. For example, the precursor web may comprise a spunbonded nonwoven as a layer. The spunbonded nonwoven may comprise a plurality of substrates which can be integrally formed with one another. For example, substrates may be produced via a spunbond process. A first substrate may be produced by a first spin beam and a second substrate may be produced via a second spin beam. Additional substrates may be produced via additional spin beams on the same spunbond manufacturing line.

Precursor webs may comprise any suitable material. For example, precursor web materials may comprise PE/PP bi-component fiber spunbond webs. Other suitable precursor webs may comprise spunbond webs comprising side-by-side crimped fibers (e.g. PE/PP or PP/PP) that are bonded via calendar (thermal point) bonding or through-air bonding. For those configurations with multiple layers a first layer and second layer of the patterned apertured web of the present invention may comprise a crimped spunbond layer. For these configurations, the crimped spunbond layers may be combined from roll stock and joined as provided herein. However, where the precursor web comprises a first substrate and a second substrate, each may be crimped spunbond substrates formed on a spunbond manufacturing line where the first substrate is formed from a first spin beam while the second substrate is formed from a second spin beam.

Other suitable precursor webs may comprise carded staple fibers comprising polypropylene, polyethylene terephthalate, polyethylene/polypropylene bi-component, polyethylene/polyethylene terephthalate bi-component, or the like, which are calendar bonded, through-air bonded, resin bonded or hydroentangled. The precursor webs may comprise microfibers and/or nanofibers, optionally with other fibers. In some circumstances, multiple layer webs may be desired over a single layer webs (even at the same basis weight) due to increased uniformity/opacity and the ability to combine webs having different properties. For example, an extensible spunbond nonwoven carrier layer may be combined with a soft, crimped fiber nonwoven (spunbond or carded). The substrates may have the same or different surface energy, for example, the top layer may be hydrophobic and the lower layer may be hydrophilic. The layers may have different permeability/capillarity, e.g. the upper layer may have higher permeability and the lower layer have higher capillarity in order to set up a capillary gradient and aid in moving fluid away from the surface (or topsheet) of an absorbent article and into an absorbent core of the absorbent article.

Additionally, the precursor webs may comprise a surface treatment and/or additive to the constituent material of the precursor web. For example, the precursor web may comprise a hydrophobic surface treatment. For such webs, a composition applied in a composition site may be hydrophilic. Still in other examples, the precursor web may comprise a hydrophilic surface treatment or the constituent material of the precursor web may comprise hydrophilic material. For such webs, a composition applied in a composition site may be hydrophobic. As another example, precursor webs of the present invention may comprise a melt additive. In one specific example, the precursor web may comprise fibers which comprise a hydrophobic melt additive. In such example, at least one of the composition sites may comprise a hydrophilic composition.

Suitable melt additives and surface treatments of materials is discussed in additional detail in U.S. Pat. Nos. 8,178,748, 8,026,188; 4,578,414; 5,969,026; U.S Patent Application Publication Nos. 2012/0100772; 2014/0272261; 2012/0296036; 2014/0087941; U.S. patent application Ser. Nos. 14/849,630; 13/833,390; European Patent No. 2411061; and PCT Patent Application Publication No. 2012/162130.

Other suitable materials for precursor webs include films. Some suitable films are described in U.S. Pat. Nos. 3,929,135; 4,324,426; 4,324,314; 4,629,643; 4,463,045; and 5,006,394.

Compositions/Composition Sites

As mentioned previously, webs of the present invention may comprise a plurality of composition sites each of which comprises a composition. Similarly, the stored pre-rendered patterns described herein may correspond to a plurality of composition sites each of which comprises a composition. The composition sites on the intermediate webs and/or secondary webs described herein may comprise a variety of compositions. For example, a first plurality of composition sites may comprise a hydrophilic composition while a second plurality of composition sites may comprise a hydrophobic composition. And, as noted previously, some webs may comprise the first plurality of composition sites sans the second plurality of composition sites or vice versa. As noted herein, a third plurality of composition sites may be applied to a web in some forms. The third plurality of composition sites may be in addition to or sans the first plurality of composition sites and/or the second plurality of composition sites. Additional composition sites may be provided on a web.

As shown in FIGS. 3A, 3B, 3C, 3D, and 4C, the composition sites described herein may be applied to the precursor web, intermediate web, or secondary web in an array of discrete sites. Forms of the present invention are contemplated where the composition sites applied to a web may be in the form of a plurality of stripes. And, while the plurality of stripes may be discrete from one another, forms are contemplated where the plurality of stripes are, at least in part, interconnected with one another. In such forms, each of the plurality of stripes may be registered with an intermediate feature and/or discontinuity or may partially overlap an intermediate features and/or discontinuity or be offset from an intermediate feature and/or discontinuity. A suitable example of composition stripes is shown in FIG. 7.

Figure 7:
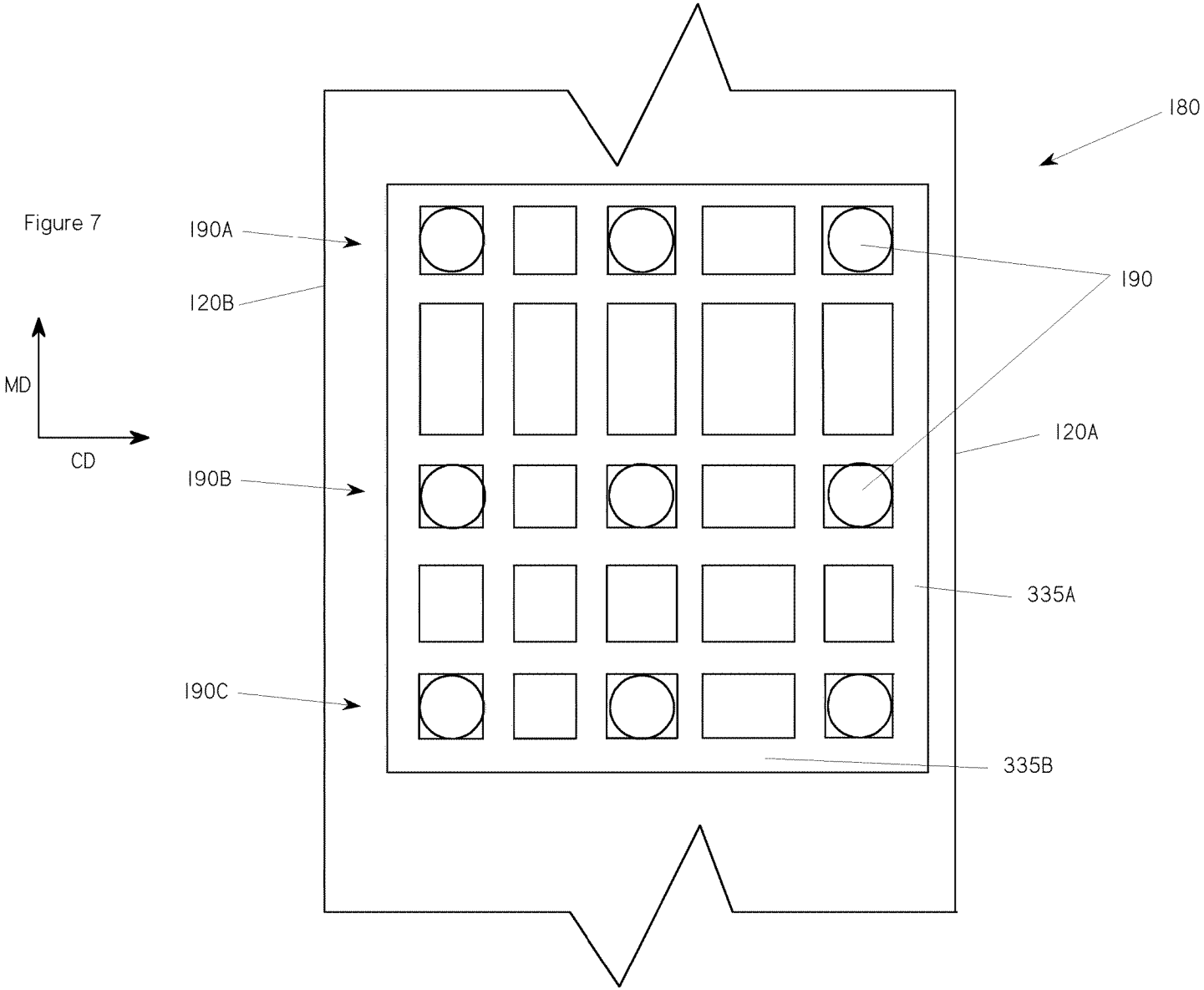
FIG. 7 is a plan view of an exemplary secondary web constructed in accordance with the present invention.

As shown in FIG. 7, composition may be applied to the secondary web 180 in a plurality of stripes 335A and 335B which extend in the MD and CD, respectively. The plurality of stripes may be connected with one another forming a grid. As shown, the grid, at least in part, may surround a plurality of discontinuities 190. Forms are contemplated where the plurality of stripes 335A and 335B surround each of the plurality of discontinuities individually. Forms are contemplated where the plurality of stripes 335A and 335B surround a group, e.g. first group 190A, of the plurality of discontinuities. Forms are contemplated where the plurality of stripes 335A and 335B surround multiple groups of the plurality of discontinuities, e.g. first group 190A and second group 190B.

Still referring to FIG. 7, the stripes 335A and 335B may be generally parallel with the MD and/or CD, respectively. In some forms, a first plurality of stripes may be generally parallel with the MD while a second plurality of stripes may be angled with respect to the MD and/or CD. In some forms, a first plurality of stripes may be generally parallel with the CD while a second plurality of stripes may be angled with respect to the CD. In some forms, a first plurality of stripes and a second plurality of stripes may each be angled with respect to the MD and CD. In such forms, the first plurality of stripes and the second plurality of stripes may interconnect with one another to form a diamond pattern. The diamond pattern may surround at least a portion of the plurality of discontinuities, may partially overlap at least a portion of the plurality of discontinuities, and/or may be registered with at least a portion of the plurality of discontinuities.

Intermediate webs of the present invention may be similarly configured. For example, intermediate webs may comprise a plurality of composition sites which comprise a plurality of stripes of composition(s). In such forms, the plurality of stripes of composition may be configured as described above with regard to FIG. 7A as applied to intermediate features.

As noted previously, composition sites may be provided to the web in a variety of configurations. Some of the configurations are discussed with regard to FIGS. 3A-3D and 4A-4C. An additional configuration is provided with regard to FIG. 8A. As shown, composition sites 335 may comprise first portion 335A and a second portion 335B. The first portion 335A may have a first portion length 820 generally parallel to the MD, and the second portion 335B may have a second portion width 830 generally parallel to the CD. Similarly, the intermediate feature 110 may comprise an intermediate feature length 880 generally parallel to the MD, and an intermediate feature width 890 generally parallel to the CD. The composition sites 335 described with regard to FIG. 8A, may be similarly configured for the discontinuities described herein.

In some forms of the present invention, the second portion width 830 may be greater than the first portion length 820. The second portion width 830 may be greater than the first portion length 820 in any suitable ratio. Some suitable ratios include about 1.1 to 1.0, about 1.2 to 1.0, about 1.3 to 1.0, about 1.4 to 1.0, about 1.5 to 1.0, about 1.6 to 1.0, about 1.7 to 1.0, about 1.8 to 1.0, about 1.9 to 1.0 about 2.0 to 1.0, about 2.5 to 1.0, or about 2.75 to 1.0, specifically including all ratios within the above and any ranges created thereby.

In some forms of the present invention, the first portion length 820 may be greater than the second portion width 830. The first portion length 820 may be greater than the second portion width 830 in any suitable ratio. Some suitable ratios include about 1.1 to 1.0, about 1.2 to 1.0, about 1.3 to 1.0, about 1.4 to 1.0, about 1.5 to 1.0, about 1.6 to 1.0, about 1.7 to 1.0, about 1.8 to 1.0, about 1.9 to 1.0 about 2.0 to 1.0, about 2.5 to 1.0, about 2.75 to 1.0, about 3.0 to 1.0, about 3.25 to 1.0, about 3.50 to 1, about 3.75 to 1, about 4.0 to 1.0, about 4.25 to 1, about 4.5 to 1, about 4.75 to 1, or about 5.0 to 1.0 specifically including all ratios within the above and any ranges created thereby.

In some forms, the first portion length 820 may be less than the intermediate feature length 880. For example, in some forms, the first portion length 820 may be less than about 90 percent of the intermediate feature length 880, less than about 80 percent, less than about 75 percent, less than about 70 percent, less than about 60 percent, less than about 50 percent, less than about 40 percent, less than about 30 percent, less than about 20 percent, less than about 10 percent, or less than about 5 percent, specifically including all values within the above and any ranges created thereby.

In some forms, the second portion width 830 may be greater than the intermediate feature width 890. For example, in some forms, the second portion width 830 may be greater than the intermediate feature width 890 by at least 10 percent, at least 20 percent, at least 30 percent, at least 40 percent, at least 50 percent, at least 60 percent, at least 70 percent, at least 80 percent, at least 90 percent at least 100 percent, at least 110 percent, at least 120 percent, at least 130 percent, at least 140 percent, at least 150 percent, at least 160 percent, at least 170 percent, at least 180 percent, at least 190 percent, or at least 200 percent, specifically including all values within the above ranges and any ranges created thereby.

In some forms, the composition site 335 may cover greater than about 10 percent of the area of the intermediate feature 110, greater than about 20 percent, greater than about 30 percent, greater than about 40 percent, greater than about 50 percent, greater than about 60 percent, greater than about 70 percent, greater than about 80 percent, greater than about 90 percent, greater than about 100 percent, greater than about 110 percent, greater than about 110 percent, greater than about 120 percent, greater than about 130 percent, greater than about 140 percent, greater than about 150 percent, greater than about 160 percent, greater than about 170 percent, greater than about 180 percent, greater than about 190 percent, or greater than about 200 percent, specifically including all values within these ranges and any ranges created thereby.

The first portion length 820, the second portion width 830, and coverage area of the composition can impact the role that the composition will play with regard to the intermediate feature 110. For example, where the intermediate feature 110 is further processed to become an aperture, it may be desirable to have a composition which comprises a hydrophilic composition. And, it may be desirable to provide as much coverage of the intermediate feature 110 as possible such that the resulting aperture has a sufficient amount of hydrophilic composition about its perimeter or resulting side wall. However, it may also be beneficial to have some intermediate features 110 having more coverage of hydrophilic composition than others.

For example, intermediate features/apertures may comprise a high percentage of composition coverage while intermediate features/apertures outside of a target zone (a zone on an article intended to be the primary area of fluid insult) have a less percentage of coverage. In such forms, the ratios described above can be utilized to customize the behavior of the resulting apertures to achieve the desired effect.

Additional configurations for composition sites are contemplated. As noted with regard to FIG. 3D, the composition sites of the present invention may comprise a plurality of dots or droplets of composition particularly where ink jet printing is utilized. With regard to FIG. 8B, the composition site 335 is shown in conjunction with a discontinuity 190. The composition sites 335 described with regard to FIG. 8B, may be similarly configured for the intermediate features described herein.

Figure 8B:
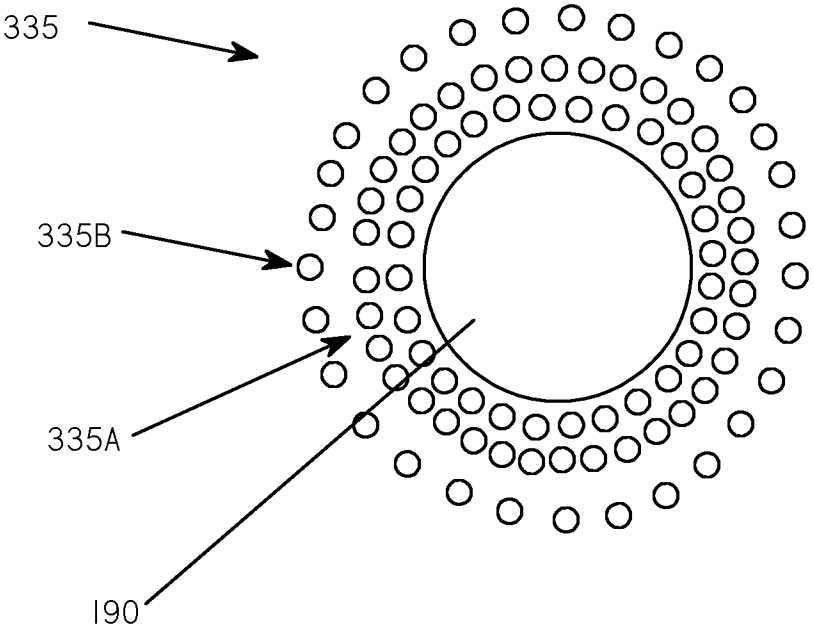
FIG. 8B is a schematic illustration of a composition site of the present invention.

Still referring to FIG. 8B, the composition site 335 may comprise the first portion 335A and the second portion 335B each of which comprises a plurality of discrete dots. For ease of illustration, the discrete dots have been enlarged. The first portion 335A may comprise a first plurality of discrete dots which are spaced apart at a particular dots per inch, "DPI" spacing. The second portion 335B may comprise a second plurality of discrete dots which are spaced apart at a different DPI. In some forms, the DPI of the first plurality of discrete dots may be greater than the DPI of the second plurality of discrete dots.

Such configurations may form a composition gradient. For example, where the discontinuity is an aperture, and the composition site comprises a surfactant, a higher DPI in the first plurality of discrete dots as opposed to the DPI of the second plurality of discrete dots would create a hydrophilicity gradient where hydrophilicity increases with decreasing distance from the aperture.

Configurations of the composition site 335 where the DPI of the second plurality of discrete dots is greater than the DPI of the first plurality of discrete dots are also contemplated. For example, where the composition site 335 comprises a hydrophobic composition, the DPI of the second plurality of discrete dots may be greater than the DPI of the first plurality of discrete dots. Such a configuration may create a hydrophobic gradient where hydrophobicity increases with increasing distance from the discontinuity 190, e.g. aperture.

Additional configurations are contemplated where the first portion 335A and the second portion 335B comprise different compositions. For example, the first plurality of discrete dots may comprise a hydrophilic composition and the second plurality of discrete dots may comprise a hydrophobic composition or vice versa.

Additionally, the composition sites described herein may correspond to a variety of features. For example, a plurality of first composition sites may be associated with apertures. For such webs, the composition provided in the plurality of first composition sites may be hydrophilic. As another example, a plurality of second composition sites may be associated with lands between apertures. For such webs, the composition provided to the plurality of second composition sites may be provided in conjunction with the plurality of first composition sites. For such webs, the composition provided in the plurality of second composition sites may be hydrophobic. Alternatively, in such forms, the composition provided in the plurality of second composition sites may be a lotion.

In some forms, intermediate features or discontinuities may be provided with composition having variable gradients. For example, intermediate features in the target zone may comprise a composition gradient which allows for quicker acquisition time through the material web, e.g. a hydrophilic composition. In contrast, intermediate features outside of the target zone may comprise composition gradient which encourages quick acquisition time but does not comprise the same amount of hydrophilic composition as those intermediate features or discontinuities in the target zone. And, some of the intermediate features outside of the target area may even comprise a hydrophobic composition to discourage rewetting problems. Composition gradients may be created as described with any of the composition described herein.

Some suitable examples of hydrophilic compositions include non-ionic surfactants including esters, amides, carboxylic acids, alcohols, ethers—polyoxyethylene, polyoxypropylene, sorbitan, ethoxylated fatty alcohols, alyl phenol polyethoxylates, lecithin, glycerol esters and their ethoxylates, and sugar based surfactants (polysorbates, polyglycosides). Other suitable examples include anionic surfactants including sulfonates, sulfates, phosphates, alkali metal salts of fatty acids, fatty alcohol monoesters of sulfuric acid, linear alkyl benzene sulfonates, alkyl diphenyloxide sulfonates, lignin sulfonates, olefin sulfonates, sulfosuccinates, and sulfated ethoxylates of fatty alcohols. Other suitable examples include cationic surfactants including amines (primary, secondary, tertiary), quaternary ammoniums, pyridinium, quaternary ammonium salts—QUATS, alkylated pyridinium salts, alkyl primary, secondary, tertiary amines, and alkanolamides. Other suitable examples include zwiterionic surfactants including amino acids and derivatives, amine oxide, betaines, and alkyl amine oxides. Other suitable examples include polymeric surfactants including polyamines, carboxylic acid polymers and copolymers, EO/PO block copolymers, ethylene oxide polymers and copolymers, and polyvinylpyrrolidone. Other suitable examples include silicone surfactants including dimethyl siloxane polymers with hydrophile. And other suitable examples include perfluorocarboxylic acid salts and fluorosurfactants.

Some suitable examples of hydrophobic compositions include fluorinated or perfluorinated polymers; silicones; fluorochemicals; zirconium compounds; oils; latexes; waxes; crosslinking resins; and blends thereof; fluorochemical urethanes, ureas, esters, ethers, alcohols, epoxides, allophanates, amides, amines (and salts thereof), acids (and salts thereof), carbodiimides, guanidines, oxazolidinones, isocyanurates, and biurets; nanostructured particles selected from fumed silica, hydrophobic titania, zinc oxide, nanoclay, and mixtures thereof; fats and oils, glycerol derivatives; hydrophobic silicones or suitable combinations thereof.

Any suitable lotion may be utilized as a composition of the present invention. Some suitable lotions are described in U.S. Patent Application Publication Nos. 2003/0206943 and 2007/0219515. Lotions suitable for use as compositions in the present invention may comprise from about 60-99.9 percent of a carrier. Suitable carrier compounds include petroleum-based hydrocarbons having from about 8 to about 32 carbon atoms, fatty alcohols having from about 12 to about 18 carbon atoms, polysiloxane compounds, fatty acid esters, alkyl ethoxylates, lower alcohols having from about 2 to about 6 carbon atoms, low molecular weight glycols and polyols, fatty alcohol ethers having from about 12 to about 22 carbon atoms in their fatty chain, lanolin and its derivatives, ethylene glycol derivatives of $C_{12}$-$C_{22}$ fatty acids, glyceride and its derivatives including acetoglycerides and ethoxylated glycerides of $C_{12}$-$C_{18}$ fatty acids, and mixtures thereof. Other suitable carriers include oils or fats, such as natural oils or fats, or natural oil or fat derivatives, in particular of plant or animal origin. Suitable carriers further encompass waxes. As used herein, the term 'wax' refers to oil soluble materials that have a waxy constituency and have a melting point or range of above ambient temperature, in particular above 25° C. Waxes are materials that have a solid to semi-solid (creamy) consistency, crystalline or not, being of relative low viscosity a little above their liquefying point. Suitable waxes which can be incorporated into the lotion composition include animal, vegetable, mineral or silicone based waxes which may be natural or synthetic, and including mixtures thereof.

Additionally, lotions suitable for use with the present invention may comprise optional ingredients such as skin treatment agents including hexamidine, zinc oxide, and niacinamide, glycerine, chamomile, panthenol, fats and oils, and/or skin conditioning agents, perfumes, deodorants, opacifiers, astringents, preservatives, emulsifying agents, film formers, stabilizers, proteins, lecithin, urea, colloidal oatmeal, pH control agents. Additional optional ingredients include particles, wetting agents, and/or viscosity or thickening agents.

Additional compositions are contemplated. For example, compositions utilized with the present invention may comprise health actives. Some examples include prebiotics which include mucopolysaccharides, oligosaccharides such as galactooligosaccharides ("GOS"), polysaccharides, amino acids, vitamins, nutrient precursors, harvested metabolic products of biological organisms, lipids, and proteins. Other suitable prebiotics are disclosed in PCT Patent Application Publication No. WO 2013122932 A2.

Other suitable health actives comprise organic acids including acetic acid, propionic acid, lactic acid, ascorbic acid, phenylalanine, citric acid, butyric acid, valeric acid, capronic acid, succinic acid and/or a salt thereof, soluble acrylic acid polymers known to the art as Carbopols®, alone or in combination with organic acids known to the art such as alphahydroxy acids, more preferably benzoic acid, alginic acid, sorbic acid, stearic acid, oleic acid, edetic acid, gluconodeltalactone, acetic acid, fumaric acid, lactic acid, citric acid, propionic acid, malic acid, succinic acid, gluconic acid, ascorbic acid and tartaric acid and the like.

Other suitable health actives include calcium salts, calcium lactate and/or calcium citrate malate, bacterial metabolites and extracellular products. In some forms, compositions useful with the present invention may comprise skin care actives including allantoin, aluminum hydroxide gel, calamine, cocoa butter, colloidal oatmeal, dimethicone, cod liver oil (in combination), glycerine, hard, fat, kaolin, petrolatum, lanolin, mineral oil, shark liver oil, white petrolatum, sodium bicarbonate, topical starch, zinc acetate, zinc carbonate, zinc oxide, and the like. Additional skin care actives are disclosed in PCT Patent Application Publication No. WO 2013/1222932. Other suitable health actives include ingredients useful for regulating and/or improving a condition of mammalian skin. Some non-limiting examples of such ingredients include vitamins; peptides and peptide derivatives; sugar amines, phytosterols, salicylic acid compounds, hexamidines, dialkanoyl hydroxyproline compounds, flavonoids, retinoid compounds, botanicals, N-acyl amino acid compounds, their derivatives, and combinations thereof. Other examples include a sugar amine, which is also known as an amino sugar. Exemplary sugar amines suitable for use herein are described in PCT Publication No. WO 02/076423 and U.S. Pat. No. 6,159,485.

Other examples of suitable compositions include a vitamin B3 compound (e.g., niacinamide). Vitamin B3 compounds may regulate skin conditions as described in U.S. Pat. No. 5,939,082. Some exemplary derivatives of the foregoing vitamin B3 compounds include nicotinic acid esters, including non-vasodilating esters of nicotinic acid (e.g., tocopheryl nicotinate, myristyl nicotinate). Other examples include a salicylic acid compound, its esters, its salts, or combinations thereof. Still other examples include hexamidine compounds, its salts and derivatives. Other suitable examples include a flavonoid compound. Flavonoids are broadly disclosed in U.S. Pat. Nos. 5,686,082 and 5,686,367.

Additional examples include one or more N-acyl amino acid compounds. The amino acid can be one of any of the amino acids known in the art. A list of possible side chains of amino acids known in the art are described in Stryer, Biochemistry, 1981, published by W.H. Freeman and Company.

Additional examples include a retinoid. "Retinoid" as used herein means natural and synthetic analogs of Vitamin A, or retinol-like compounds which possess the biological activity of Vitamin A in the skin, as well as the geometric isomers and stereoisomers of these compounds.

Other suitable examples may comprise a peptide, including but not limited to, di-, tri-, tetra-, penta-, and hexapeptides and derivatives thereof. Peptides may contain ten or fewer amino acids and their derivatives, isomers, and complexes with other species such as metal ions (e.g., copper, zinc, manganese, magnesium, and the like). Peptide refers to both naturally occurring and synthesized peptides. Also useful herein are naturally occurring and commercially available compositions that contain peptides.

Compositions of the present invention may also include one or more water-soluble vitamins Examples of water-soluble vitamins including, but are not limited to, water-soluble versions of vitamin B, vitamin B derivatives, vitamin C, vitamin C derivatives, vitamin K, vitamin K derivatives, vitamin D, vitamin D derivatives, vitamin E, vitamin E derivatives, provitamins thereof, such as panthenol and mixtures thereof.

Other suitable ingredients include a conditioning agent such as a humectant, a moisturizer, or a skin conditioner. Some non-limiting examples of conditioning agents include, but are not limited to, guanidine; urea; glycolic acid and glycolate salts (e g ammonium and quaternary alkyl ammonium); salicylic acid; lactic acid and lactate salts (e.g., ammonium and quaternary alkyl ammonium); aloe vera in any of its variety of forms (e.g., aloe vera gel); polyhydroxy alcohols such as sorbitol, mannitol, xylitol, erythritol, glycerol, hexanetriol, butanetriol, propylene glycol, butylene glycol, hexylene glycol and the like; polyethylene glycols; sugars (e.g., melibiose) and starches; sugar and starch derivatives (e.g., alkoxylated glucose, fucose); hyaluronic acid; lactamide monoethanolamine; acetamide monoethanolamine; panthenol; allantoin; and mixtures thereof. Also useful herein are the propoxylated glycerols described in U.S. Pat. No. 4,976,953. Also useful are various C1-C30 monoesters and polyesters of sugars and related materials. These esters are derived from a sugar or polyol moiety and one or more carboxylic acid moieties.

In some forms, indication reagents which provide an indication and/or detection of a medical condition may be printed as described herein. In some forms, indication reagents are contemplated that may provide an indication and/or detection of a medical condition and may do so when wetted with sweat, menses, vaginal discharge, urine, feces, or combinations thereof. In one specific form, indication reagents are contemplated that provide such indication and/or detection when contacted by urine of a wearer. This reaction is often associated with a color change in the indication reagent. Some suitable examples of reagents include: (a) 16.3% Glucose Oxidase, 0.6% Proxidase, and 7.0% Potassium iodide, for the indication of glucose in urine; (b) 22.5% Cumene-hydroperoxide or 3,3',5,5' tetramethylbenzidine for the indication of blood in urine; (c) 0.04% naphthyl ester or 0.2% diazonium salt for the indication of leukocytes; (d) 1.4% p-arsanilic acid or 1,2,3,4 tetrhydrobenzo quinolin for the indication of nitrite; (e) 0.2% methyl red or 2.8% bromthymol blue for the indication of pH; (f) 0.3% tetrabromphenol blue for the indication of protein; (g) 7.1% sodium nitroprusside for the indication of ketones; (h) 0.4% 2,4-dichloroaniline or diazonium salt for the indication of bilirubin; (i) 2.9% p-diethylamino-benzaldehyde for the indication of urobilinogen; and (j) 2.8% bromthymol blue or 1.2% polyacid for the indication of specific gravity.

The indication reagents above can also simply be provided to indicate the presence of moisture. For example, the indication reagents above may have a first color when dry and a second color when wetted with a fluid/moisture. The second color may or may not provide an indication of a medical condition. In such forms, the indication reagents may simply provide an indication that moisture is present or that the indication reagent has experience a fluid insult. In such forms, sweat, menses, urine, feces, and/or vaginal discharge may trigger the change from the first color change to the second color change. In some forms, the color change between the first color and the second color is in the visible light spectrum.

While color changing agents are known in the art of diapers, e.g. wetness indicators, these color changing agents utilize an adhesive which is typically applied via slot coat. Such adhesives are typically not suitable for use in printers because of their rheology.

Regardless of the composition being printed to the web, it is important to consider the rheology of the compositions being applied. For example, viscosity of the composition can be an important factor as viscosities which are too low can migrate out of the applied area, e.g. first composition sites. In contrast, a composition with too high of a viscosity can be difficult to apply via digital printer. And, other forms of application of the composition may prove to be much slower than that of the digital printer.

The composition of the present invention may be formulated to optimize its deposition by non-contact printing, e.g. ink jet printing. For example, the components of the desired composition can be dissolved or dispersed in a suitable solvent, such as water or another organic solvent. Some suitable organic solvents include ketones such as acetone, diethyl ketone, cyclophexanone and the like. Additional suitable solvents include alcohols such as methanol, ethanol, n-propanol, isopropanol, n-butanol, 1-methoxy-2-propanol, and the like. Additional suitable solvents include esters such as ethyl acetate, propyl acetate, butyl acetate and the like. Additional examples include ethers, lactones and amides. If desired, a mixture of solvents may be used. Additionally surfactants, rheology modifiers, and colorants such as dyes or pigments may be added to the formulation.

In some forms, thermal energy may be applied to the composition to achieve the appropriate viscosity. For example, the composition when heated would be expected to have a lower viscosity than at lower temperatures.

Inkjet printing generally relies on the generation of sequences of droplets. Behavior of the composition during droplet ejection is dependent on material properties such as density, viscosity and surface tension. The behavior of a composition when inkjet printed can be predicted via two dimensionless numbers, i.e. Ohnesorge number and Weber number. The equation for determining the Oh number is provided below.

$$\mathrm{Oh} = \frac{\eta}{\sqrt{\rho\gamma L}}$$

where η is viscosity, p is density, y is surface tension of the composition, and L is the characteristic diameter (print head nozzle diameter for inkjet printing in meters).

Stable drop formation can be characterized by the reciprocal of the Ohnesorge number, namely Z=1/Oh. Stable drop formation can be expected from compositions when 14≥Z≥1. The viscosity of the desired composition should be measured at target operating temperature with shear rates between 200 and 20 s−1. The surface tension should be recorded in N/m. The density should be calculated in kg/m3, and the viscosity should be recorded in Pa·s.

Additionally, a composition of the present invention may comprise a Weber number of between about 4 and 1000. The Weber number may be calculated as follows:

$$\mathrm{We} = \frac{v^2\rho L}{\gamma}$$

where ρ is the density of the composition in kg/m3; ν is the velocity of the composition in m/s; L is the characteristic diameter (print head nozzle diameter for inkjet printing; and y is the surface tension in N/m.

The compositions of the present invention may comprise a viscosity of between about 5 and 25 centipoise. The compositions may comprise a surface tension of between about 25 and 40 dynes/cm. In some forms of the present invention, the compositions may comprise a density of from about 0.6 grams/cubic cm to about 2.0 grams/cubic cm, specifically including all values within this range and any ranges created thereby.

Equipment:

The camera 131 can be fixed with respect to a manufacturing line such that the centerline of the camera 131 is co-linear with the machine centerline 130. In some forms, the centerline of the camera 131 is not co-linear with the machine centerline 130 but utilizes the machine centerline 130 and/or another fixed reference.

Any suitable camera may be utilized. For example, a camera having a bit depth of at least 8 may be utilized. In another example, a camera having a bit depth of at least 12 or at least 16 may be utilized. Cameras with higher bit depth can provide the computational device with much more numerical resolution allowing for better filtering of images by the computational device.

Any suitable computational device may be utilized with the present invention. Some suitable examples can include central processing units (CPU), graphical processing units (GPU), and/or field programmable gate arrays (FPGA). The processing power/speed of the computational device may vary depending on the speed of the manufacturing line of which images are being provided to the computational device. For example, faster line speeds may require additional processing power to ensure that the computational device can keep up with the images being provided by the camera. In some forms of the present invention, manufacturing line speeds can be greater than about 1 m/s, greater than about 3 m/s, greater than about 4 m/s, greater than about 5 m/s, greater than about 6 m/s, greater than about 7 m/s, greater than about 8 m/s, greater than about 9 m/s, greater than about 10 m/s, greater than about 11 m/s, greater than about 12 m/s, greater than about 13 m/s or greater than about 14 m/s specifically including all values within the above values and any ranges created thereby.

The computational device can comprise any suitable vision analysis software. Some suitable examples include National Instruments® Vision Development Module, MathWorks® Image Processing toolkit, OpenCV—open source computer vision library written in C++, or ImageJ. The vision analysis software can allow a user to extract a Fourier plane from the image provided by the camera and extract the phase plane from the image provided by the camera. Depending on the intermediate features and/or discontinuities being analyzed, settings may need to be adjusted. For example, apertures may be difficult to discern in low basis weight nonwovens without adjustment to the filtering to reduce the noise of the image signal. However, less filtering may be required for the same size apertures in a higher basis weight nonwoven. Samples of the images to be analyzed can be used in test runs to hone the filter settings and produce a signal which can provide accurate results.

Similarly, samples may be utilized to determine the best highlighting method for the intermediate features and/or discontinuities. For example, backlighting may be used to highlight apertures. However, backlighting may not provide good results for highlighting melt stabilized areas—intermediate features—on the web. As such, depending on the intermediate features and/or discontinuities being detected, different highlighting mechanisms can be used to determine which highlighting system provides the best image and best resolution for the computational device. Some suitable examples for highlighting intermediate features and/or discontinuities include backlighting, front lighting, side lighting, UV lighting, X-ray, thermal response, laser topography, the like or combinations thereof.

In some specific forms, polarized backlighting may be utilized. For example, where intermediate features comprise melt stabilized areas, the highlighting method may require a polarized backlight in conjunction with an analyzer on the camera. The analyzer on the camera may be oriented at 90 degrees to the polarizer.

Where low basis weight nonwovens are utilized, conventional lighting may not provide sufficient distinction between apertures and/or melt stabilized areas and thin areas of the nonwoven. With polarized backlighting, apertures in low basis weight nonwovens may appear light where the remainder of the nonwoven appears dark and provide sufficient distinction between apertures and thin areas of a nonwoven. The use of polarized backlighting is discussed in additional detail in U.S. Patent Application Ser. No. 62/291,566.

Additional forms of the present invention are contemplated where contrasting color materials may be utilized to facilitate visualization of features by the vision system. For example, a nonwoven laminate comprising contrasting color layers may facilitate viewing of the discontinuities, e.g. melt stabilized area. Further examples of color enhancement of discontinuities is described in U.S. patent application Ser. No. 14/933,017, As noted previously, the vision analysis software can allow analysis of an image via the Fourier and phase plane of the image. Additionally, the vision analysis software can allow for comparisons between predetermined patterns and images from the camera—pattern recognition. Where the periodicity of the intermediate features and/or discontinuities is too disparate, Fourier analysis may not be appropriate. In such instances, pattern recognition may provide more accurate results/more accurate instructions to the printer. A pattern or a plurality of patterns of intermediate features and/or discontinuities would need to be provided to the computational device and/or printer such that the comparison could be made between the transmitted image and the stored pattern(s).

For pattern recognition, a plurality of patterns may be stored in the computational device and/or printer to address potential phase shift of the pattern with respect to its web. The plurality of patterns may account for phase shifts of the intermediate features and/or discontinuities in the web.

Configurations are contemplated where the camera provides an image to the computational device which then creates a print file from the image. The print file can then be provided to the printer without the need for analysis. For example, the print file can account for any phase shift in the MD or CD. In this form, the need for predetermined patterns may be obviated.

Any suitable printer may be utilized with the present invention. As noted previously, the composition sites may comprise a plurality of discrete dots or droplets. The volume of the ink droplets can depend on the particular printing technology. By way of example, printing units that are VIDEOJET™ continuous ink jet printers can have ink drop volumes of about 240 ρL and are delivered at relatively high drop velocities (e.g., about 13 m/s). Other printing technology (e.g. piezo drop on demand) can deliver ink drops having relatively small volumes, such as ink drops having a volume ranging from about 1 ρL to about 24 ρL and believed to be as high as about 80 ρL in some forms. These drops are delivered at lower drop velocities (i.e., about ½ m/s) than continuous inkjet printing. Those skilled in the art know there are different inkjet technologies (e.g., continuous, piezo, thermal, valve) and different drop size ranges and different jet velocities. In general, smaller drop size infers that the CD dpi (resolution) is higher. The range 1-24 ρL would equate to a CD resolution of 300-600 dpi. The VIDEOJET CD resolution is 128 dpi. So, more drops in CD can mean better opportunity to hit a fiber, which can result in better image quality and less ink blow-though. The slower the drop speed, the less ink blow-through.

An exemplary continuous ink jet printer is available from Videojet™ sold under the trade name of Videojet BX™. For the continuous ink jet printer, the ink droplets are dispensed from all of the jets of the print heads continuously, but only certain ink droplets are allowed to reach the precursor web, intermediate web, or secondary web, at the composition sites. The other ink droplets can be prevented from reaching the precursor web, intermediate web, or secondary web by deflecting the ink droplets into a recycling flow for a continuous re-use. The operation of the individual ink jets of each print head can be controlled by a controller included in the Videojet BX™ system.

Exemplary drop on demand printers for use in the present invention may comprise multiple print heads allowing for the deposition of a plurality of compositions. In general, the printer of the present invention may comprise a controller, one or more print heads, and a composition management system. A suitable example of a printer includes the 1024 PH development kit available from FujiFilm Dimatix™ located in New Hampshire. A suitable example of the print heads which may be utilized, includes SG-1024 MA available from FujiFilm Dimatix™. Forms of the present invention are contemplated where the controller 120 (See FIGS. 1A, 2, 4A, and 4D) is utilized as the controller for the printer described above. Additional forms are contemplated where the printer described above comprises a separate controller in addition to the controller 120. Still in other forms of the present invention, where the need for a vision system is optional based upon the above disclosure, the controller for the printer may operate without the controller 120.

The webs of the present invention may be processed to a further extent to create disposable absorbent article. Some suitable examples include diapers, diaper pants, feminine pads, adult incontinence pads, etc. The webs of the present invention may form any suitable portion of a disposable absorbent article. For example, the webs of the present invention may form a portion of a topsheet, a backsheet, or an absorbent core which is disposed between the toposheet and the backsheet. In some forms, the webs of the present invention may be utilized to form barrier cuffs for a disposable absorbent article. In other forms, the webs of the present invention may be form a portion of at least one or more of the topsheet, backsheet, secondary topsheet, acquisition layer, distribution layer, absorbent core dusting layer, backsheet, barrier cuff, wing of a sanitary pad, ear on a diaper, or the like. In some specific form, such as the application of chemical reagents that can indicate and/or detect a medical condition, the chemical reagents may be applied to webs which will be subjected to liquid insult. For example, a topsheet, a secondary topsheet, an absorbent core, a core wrap, etc.

ADDITIONAL EXAMPLES

Some exemplary processes for depositing composition(s) on a web are contemplated.

Example A

A method of non-contact printing composition(s) on a web, the method comprising the steps of: providing the web with a plurality of apertures and/or intermediate features arranged in a plurality of groups; advancing the web; and non-contact printing a first composition in a first plurality of composition sites, wherein at least some of the first plurality of composition sites are registered with at least some of the plurality of apertures and/or intermediate features.

Example B

A method of non-contact printing composition(s) on a web, the method comprising the steps of: providing a web with plurality of intermediate features arranged in one or more groups; capturing an image of at least a first group of intermediate features; analyzing the image to determine a phase shift for the first group of intermediate features; comparing the determined phase shift to a plurality of stored pre-rendered patterns; non-contact printing a first composition on the web in accordance with one of the plurality of pre-rendered patterns which most closely corresponds to the determined phase shift; and manipulating the web to transform the plurality of intermediate features into a plurality of apertures.

Example C

A method of non-contact printing composition(s) on a web, the method comprising the steps of: providing a web with plurality of intermediate features arranged in one or more groups; capturing an image of at least a first group of intermediate features; providing the captured image to a printer; non-contact printing a first composition on the web in a first plurality of composition sites; and manipulating the web to transform the plurality of intermediate features into a plurality of apertures.

Example D

A method of non-contact printing composition(s) on a web, the method comprising the steps of: providing a web with a plurality of apertures, wherein each of the plurality of apertures have an effective surface area of about 0.1 $mm^2$ to 15 $mm^2$; moving the web at a speed of greater than about 3 m/s through a visual inspection station; capturing an image of the web; providing the captured image to a computational device; determining a phase shift for a first group of the plurality of apertures on the web; comparing the determined phase shift to a plurality of pre-rendered patterns; and non-contact printing a first composition to the web in accordance with one of the pre-determined patterns which most closely correlates to the determined phase shift.

Example E

A method of non-contact printing composition(s) on a web, the method comprising the steps of: providing a web with plurality of apertures arranged in one or more groups; capturing an image of at least a first group of apertures; providing the captured image to a printer; and non-contact printing a first composition on the web in a first plurality of composition sites.

Example F

A method of method of non-contact printing composition(s) on a web, the method comprising the steps of: providing a web; printing a first composition in a first plurality of composition sites, wherein each of the first plurality of composition sites comprise a plurality of discrete dots, wherein a first portion of first plurality of composition sites are provided in a target zone and have a first composition gradient and a second portion of the first plurality of composition sites are provided outside the target zone and have a second composition gradient.

Example G

A method of non-contact printing composition(s) on a web, the method comprising the steps of: providing the web; non-contact printing a first composition to the web in a first plurality of composition sites; advancing the web; and manipulating the web to form a plurality of apertures and/or intermediate features, wherein the plurality of apertures and/or intermediate features correspond with the first plurality of composition sites.

Contact Angle Method

Contact Angle is measured using a sessile drop experiment. A specified volume of Type II reagent distilled water (as defined in ASTM D1193) is applied to the surface of a test sample using an automated liquid delivery system. A high speed video camera captures time-stamped images of the drop over a 6 second time period at a rate of 900 frames per second. The contact angle between the drop and the surface of the test sample is determined for each captured image by image analysis software. All measurements are performed at constant temperature (23° C.±2) C.° and relative humidity (50%±2%).

An automated contact angle tester is required to perform this test. The system consists of a light source, a video camera, a horizontal specimen stage, a liquid delivery system with a pump and micro syringe and a computer equipped with software suitable for video image capture, image analysis and reporting contact angle data. A suitable instrument is the Optical Contact Angle Measuring System OCA 20 (DataPhysics Instruments, Filderstadt, Germany), or equivalent. The system must be able to deliver a 3 microliter drop and be capable of capturing images at a rate of 900 frames per second. The system is calibrated and operated per the manufacturer's instructions, unless explicitly stated otherwise in this testing procedure.

To obtain a test sample for measurement, lay a single layer of the dry substrate material out flat and cut a rectangular test sample 15 mm in width and about 70 mm in length. The width of the sample may be reduced as necessary to ensure that the test region of interest is not obscured by surrounding features during testing. With a narrower sample strip care must be taken that the liquid drop does not reach the edge of the test sample during testing, otherwise the test must be repeated. Precondition samples at 23° C.±2 C.° and 50%±2% relative humidity for 2 hours prior to testing.

If the substrate material is a layer of an absorbent article, for example a topsheet or backsheet nonwoven, acquisition layer, distribution layer, or other component layer; tape the absorbent article to a rigid flat surface in a planar configuration. Carefully separate the individual substrate layer from the absorbent article. A scalpel and/or cryogenic spray (such as Cyto-Freeze, Control Company, Houston Tex.) can be used to remove a substrate layer from additional underlying layers, if necessary, to avoid any longitudinal and/or lateral extension of the material. Once the substrate layer has been removed from the article proceed with cutting the test sample.

A test sample may be cut from any location containing the aperture to be analyzed. The test region is located at a point along the aperture perimeter, as close to the aperture edge as possible, without the liquid drop reaching the edge of the aperture during testing except by modes such as wicking, wetting, or absorbtion, otherwise the test must be repeated. Care should be taken to avoid folds, wrinkles or tears when selecting a location for sampling.

The test sample is positioned onto the horizontal specimen stage with the test region in the camera's field of view beneath the liquid delivery system needle, with the test side facing up. The test sample is secured in such a way that it lies flat but unstrained, and any interaction between the liquid drop and the underlying surface is avoided to prevent undue capillary forces. A 33 gauge blunt tip stainless steel needle (ID 0.18 mm, OD 0.21 mm) is positioned above the test sample with at least 2 mm of the needle tip in the camera's field of view. Adjust the specimen stage to achieve a distance of about 2 mm between the tip of the needle and the surface of the test sample. A 3 microliter drop of reagent distilled water is formed at a rate of 1 microliter per second and allowed to freely fall onto the surface of the test sample. Video image capture is initiated prior to the drop contacting the surface of the test sample, and subsequently a continual series of images is collected for a duration of 6 seconds after the drop contacts the surface of the test sample. Repeat this procedure for a total of five (5) substantially similar replicate test regions. Use a fresh test sample or ensure that the previous drop's wetted area is avoided during subsequent measurements.

On each of the images captured by the video camera, the test sample surface and the contour of the drop is identified and used by the image analysis software to calculate the contact angle for each drop image and reported to the nearest 0.1 degree. The contact angle is the angle formed by the surface of the test sample and the tangent to the surface of the liquid drop in contact with the test sample. For each series of images from a test, time zero is the time at which the liquid drop makes contact with the surface of the test sample. Measure and record the contact angle on the drop image that corresponds to time zero plus five (5) seconds. The contact angle at five seconds is reported as 0° if the droplet has been completely absorbed by the test sample within 5 seconds. Repeat this procedure for the five replicate test regions. Calculate the arithmetic mean of the contact angle at five seconds for the five replicate test regions, and report this value as the Contact Angle to the nearest 0.1 degrees.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of non-contact printing composition(s) on a web, the method comprising the steps of:

providing the web;

forming a plurality of intermediate features in the web;

non-contact printing a first composition to the web in a first plurality of composition sites, wherein each of the first plurality of compositions sites corresponds to an intermediate feature;

manipulating the web to form a plurality of apertures from the first plurality of intermediate features;

capturing an image of a first group of the plurality of intermediate features;

analyzing the image to determine a phase shift for the first group; and non-contact printing the first plurality of composition sites in accordance with the image.

2. The method of claim 1, wherein the first composition is hydrophilic.

3. The method of claim 2, wherein the each of the first plurality of composition sites comprise a first portion and/or a second portion, wherein the first portion is disposed about a portion of the apertures and the second portion is disposed on a sidewall of the apertures.

4. The method of claim 1, further comprising the step of comparing the phase shift to a plurality of pre-rendered patterns which most closely corresponds to the determined phase shift.

5. The method of claim 1, wherein the first plurality of composition sites comprise a plurality of stripes.

6. The method of claim 5, wherein at least some of the first plurality of composition sites comprise a first portion and a second portion, wherein the first portion has a length and the second portion has a width.

7. The method of claim 1, wherein each of the first plurality of composition sites comprise a plurality of discrete dots, and wherein at least a portion of the first plurality of composition sites comprise a composition gradient.

8. A method of non-contact printing composition(s) on a web, the method comprising the steps of:

providing the web;

forming a plurality of intermediate features in the web;

non-contact printing a first composition to the web in a first plurality of composition sites, wherein each of the first plurality of compositions sites corresponds to an intermediate feature, wherein the first composition is more hydrophilic than the second composition;

manipulating the web to form a plurality of apertures from the first plurality of intermediate features; and non-contact printing a second composition on the web in a second plurality of composition sites.

9. The method of claim 8, wherein the second composition is selected from a treatment composition and an indication reagent.

10. The method of claim 8, wherein at least a portion of the second plurality of composition sites are offset with regard to the plurality of apertures.

11. The method of claim 8, wherein each of the second plurality of composition sites comprise a plurality of discrete dots.

12. A method of non-contact printing composition(s) on a web, the method comprising the steps of:

providing the web;

forming a plurality of intermediate features in the web;

non-contact printing a first composition to the web in a first plurality of composition sites, wherein each of the first plurality of compositions sites corresponds to an intermediate feature;

manipulating the web to form a plurality of apertures from the first plurality of intermediate features; and capturing an image of at least a portion of the intermediate features and transferring the image to a printer as a print file.

* * * * *